US006139014A

United States Patent [19]

Breeding et al.

[11] Patent Number: 6,139,014

[45] **Date of Patent: *Oct. 31, 2000**

[54] METHOD AND APPARATUS FOR AUTOMATICALLY CUTTING AND SHUFFLING PLAYING CARDS

[75] Inventors: John G. Breeding, St. Louis Park; Attila Grauzer, Plymouth; Paul K. Scheper, Eden Prairie; James B. Stasson, Chanhassen; Nick W. Kukuczka, Bloomington, all of Minn.

[73] Assignee: Shuffle Master, Inc., Eden Prairie, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,742

[22] Filed: Jul. 15, 1997

Related U.S. Application Data

[63] Continuation of application No. 08/504,035, Jul. 19, 1995, Pat. No. 5,695,189, which is a continuation of application No. 08/287,729, Aug. 9, 1994, abandoned.

[51] Int. Cl.[7] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 2,159,958 | 5/1939 | Sachs | 273/149 R |
| 2,676,020 | 4/1954 | Ogden | 273/149 R |
| 2,778,644 | 1/1957 | Stephenson | 273/149 R |
| 2,790,641 | 4/1957 | Adams | 273/149 R |
| 4,310,160 | 1/1982 | Willette et al. | 273/149 R |
| 4,497,488 | 2/1985 | Plevyak et al. | 273/149 R |
| 4,513,969 | 4/1985 | Samsel, Jr. | 273/149 R |
| 4,515,367 | 5/1985 | Howard | 273/149 R |
| 4,586,712 | 5/1986 | Lorber et al. | 273/149 R |
| 4,770,421 | 9/1988 | Hoffman | 273/149 R |
| 4,807,884 | 2/1989 | Breeding | 273/149 R |
| 4,832,342 | 5/1989 | Plevyak et al. | 273/149 R |
| 4,969,648 | 11/1990 | Hollinger et al. | 273/149 R |
| 5,000,453 | 3/1991 | Stevens et al. | 273/149 R |
| 5,154,492 | 10/1992 | Levarai et al. | 303/9.69 |
| 5,261,667 | 11/1993 | Breeding | 273/149 R |
| 5,275,411 | 1/1994 | Breeding | 273/149 R |
| 5,303,921 | 4/1994 | Breeding | 273/149 R |
| 5,356,145 | 10/1994 | Verschoor | 273/149 R |

*Primary Examiner*—Benjamin H. Layno
*Attorney, Agent, or Firm*—Dorsey & Whitney LLP

[57] ABSTRACT

The present invention provides a machine for shuffling multiple decks of playing cards including a first vertically extending magazine for holding a stack of unshuffled playing cards, and second and third vertically extending magazines each for holding a stack of cards, the second and third magazines being horizontally spaced from and adjacent to the first magazine. A first card mover is at the top of the first magazine for moving cards from the top of the stack of cards in the first magazine to the second and third magazines to cut the stack of unshuffled playing cards into two unshuffled stacks. Second and third card movers are at the top of the second and third magazines, respectively, for randomly moving cards from the top of the stack of cards in the second and third magazines, respectively, back to the first magazine, thereby interleaving the cards to form a vertically registered stack of shuffled cards in the first magazine.

19 Claims, 17 Drawing Sheets

METHOD AND APPARATUS FOR AUTOMATICALLY CUTTING AND SHUFFLING PLAYING CARDS

The above identified patent application is a continuation of prior application Ser. No. 08/504,035, filed Jul. 19, 1995, now U.S. Pat. No. 5,695,189, which is a continuation of prior application Ser. No. 08/287,729, filed Aug. 9, 1994, now abandoned.

TECHNICAL FIELD

The present invention relates to devices for shuffling playing cards used in playing games. In particular, it relates to an electromechanical machine for shuffling playing cards, wherein the machine is specifically adapted to shuffle multiple decks of playing cards to improve casino play of card games.

BACKGROUND OF THE INVENTION

Wagering games based on the outcome of randomly generated or selected symbols are well known. Such games are widely played in gambling casinos and include card games wherein the symbols comprise familiar, common playing cards. Card games such as twenty-one or blackjack, Pai Gow poker, Caribbean Stud™ poker and others are excellent card games for use in casinos. Desirable attributes of casino card games are that they are exciting, that they can be learned and understood easily by players, and that they move or are played rapidly to their wager-resolving outcome.

One of the most popular of the above-mentioned casino games is twenty-one. As outlined in U.S. Pat. No. 5,154,492 (LeVasseur), conventional twenty-one is played in most casinos and involves a game of chance between a dealer and one or more players. The object is for the player to achieve a count of his hand closer to 21 than the count of the hand of the dealer. If the count of the player's hand goes over 21 then the player loses regardless of the final count of the dealer's hand.

At least one standard deck of playing cards is used to play the game. Each card counts its face value, except aces which have a value of one or eleven as is most beneficial to the count of the hand. Each player initially receives two cards. The dealer also receives two cards. One of the dealer's cards is dealt face down and the other of the dealer's cards is dealt face up.

A player may draw additional cards (take "hits") in order to try and beat the count of the dealer's hand. If the player's count exceeds 21, the players "busts." The player may "stand" on any count of 21 or less. When a player busts, he loses his wager regardless of whether or not the dealer busts. After all of the players have taken hits or stood on their hand, the dealer "stands" or "hits" based on pre-established rules for the game. Typically, if the dealer has less than 17, the dealer must take a hit. If the dealer has 17 or more, the dealer stands.

After the dealer's final hand has been established, the numerical count of the dealer's hand is compared to the numerical count of the player's hand. If the dealer busts, the player wins regardless of the numerical count of his hand. If neither the player nor the dealer have busted, the closest hand to numerical count of 21, without going over, wins; tie hands are a "push."

As used in the preceding description and in this disclosure, the terms "conventional twenty-one" and "the conventional manner of play of twenty-one" mean the game of twenty-one as described herein and also including any of the known variations of the game of twenty-one.

Twenty-one has remained remarkably popular and unchanged over the years. Because of its popularity, the rapidity of play, and the need to reduce or eliminate card counting by players, twenty-one is usually played with multiple decks that are frequently shuffled. Thus, from the perspective of a casino, the play of a round of twenty-one takes a predictable length of time. In particular, the time the dealer must spend in shuffling diminishes the excitement of the game and reduces the number of wagers placed and resolved in a given amount of time. Modifications of the basic twenty-one game, including the LeVasseur modification, have been proposed to speed play or otherwise increase the number of wagers made and resolved, but none of these modifications have achieved a large measure of popularity, probably because they change the game.

Casinos would like to increase the amount of revenue generated by the game of twenty-one in the same time period without changing the game or simply increasing the size of the wagers of the player. Therefor, another approach to speeding play is directed specifically to the fact that playing time is diminished by shuffling and dealing. This problem is particularly acute in games such as twenty-one, but in other casino games as well, for which multiple shuffled decks are used and has lead to the development of electromechanical or mechanical card shuffling devices. Such devices increase the speed of shuffling and dealing, thereby increasing playing time, adding to the excitement of a game by reducing the time the dealer or house has to spend in preparing to play the game.

U.S. Pat. No. 4,513,969 (Samsel, Jr.) and U.S. Pat. No. 4,515,367 (Howard) disclose automatic card shufflers. The Samsel, Jr. patent discloses a card shuffler having a housing with two wells for receiving two reserve stacks of cards. A first extractor selects, removes and intermixes the bottommost card from each stack and delivers the intermixed cards to a storage compartment. A second extractor sequentially removes the bottommost card from the storage compartment and delivers it to a typical shoe from which the dealer may take it for presentation to the players. The Howard patent discloses a card mixer for randomly interleaving cards including a carriage supported ejector for ejecting a group of cards (approximately two playing decks in number) which may then be removed manually from the shuffler or dropped automatically into a chute for delivery to a typical dealing shoe.

U.S. Pat. No. 4,586,712 (Lorber, et al.) discloses an automatic shuffling apparatus designed to intermix cards under the programmed control of a computer and is directed toward reducing the dead time generated when a casino dealer manually has to shuffle multiple decks of playing cards. The Lorber, et al. apparatus is a carousel-type shuffler having a container, a storage device for storing shuffled playing cards, a removing device and an inserting device for intermixing the playing cards in the container, a dealing shoe and supplying means for supplying the shuffled playing cards from the storage device to the dealing shoe.

U.S. Pat. No. 5,000,453 (Stevens et al.) discloses an apparatus for automatically shuffling and cutting cards. The Stevens et al. machine includes three contiguous magazines with an elevatable platform card supporting means in the center magazine only. Unshuffled cards are placed in the center magazine and the spitting rollers at the top of the magazine spit the cards randomly to the left and right magazine where they accumulate. This amounts to a simultaneous cutting and shuffling step. The cards are moved back into the center magazine by direct lateral movement of each shuffled stack, placing one stack on top of the other to stack all cards in a shuffled stack in the center magazine. The order of the cards in each stack does not change in moving from the right and left magazines into the center magazine. The Stevens et al. device does not provide a distinct cutting step in the shuffling procedure. Cutting is a traditional step taken before shuffling cards and provides a sense of security for card players. In a further departure from "normal" manual or hand shuffling, the Stevens et al. device shuffles cards by randomly diverging cards from an unshuffled stack of cards. Normally, cards are cut and then randomly merged to interleaf them into a single stack of shuffled cards.

Other known card shuffling devices are disclosed in U.S. Pat. No. 2,778,644 (Stephenson), U.S. Pat. No. 4,497,488 (Plevyak et al.), U.S. Pat. Nos. 4,807,884 and 5,275,411 (the latter two patents issued to John G. Breeding, a co-inventor of the present invention, and commonly owned). The Breeding patents disclose machines for automatically shuffling a single deck of cards including a deck receiving zone, a carriage section for separating a deck into two deck portions, a sloped mechanism positioned between adjacent corners of the deck portions, and an apparatus for snapping the cards over the sloped mechanism to interleave the cards. They are directed to providing a mechanized card shuffler whereby a deck may be shuffled often and yet the dealer still has adequate time to operate the game being played. Additionally, the Breeding shuffling devices are directed to reducing the chance that cards become marked as they are shuffled and to keeping the cards in view constantly while they are being shuffled.

One reason why known shuffling machines, with the exception of the Breeding machines, have failed to achieve widespread use is that they involve or use non-traditional manipulation of cards, making players wary and uncomfortable. Although the devices disclosed in the preceding patents, particularly the Breeding single deck card shuffling machines, provide significant improvements in card shuffling devices, such devices could be improved further if they could automatically, effectively and randomly shuffle together multiple decks of playing cards in a shuffling operation which approximates as closely as possible the steps in manual or hand shuffling.

Accordingly, there is a need for a shuffling machine for shuffling playing cards, wherein the machine is adapted to facilitate the casino play of card games wherein it is advantageous to have intermingled, multiple decks of cards shuffled and ready for use.

SUMMARY OF THE INVENTION

The problems outlined above are in large measure solved by the card shuffling machine of the present invention, which provides for randomly shuffling together multiple decks of playing cards to facilitate the casino play of certain wagering games, particularly the game known as twenty-one or blackjack.

The present invention comprises an electromechanical card shuffling machine for shuffling intermingled multiple decks of playing cards, most typically four to eight decks. The shuffling procedure is controlled by an integral microprocessor and monitored by a plurality of photosensors and limit switches. The machine includes a first vertically extending magazine for holding a vertically registered stack of unshuffled playing cards, and second and third vertically extending magazines for holding a vertically registered stack of cards, the second and third magazines being horizontally spaced from and adjoining the first magazine. A first card mover is disposed at the top of the first magazine for individually engaging and moving cards from the top of the stack of cards in the first magazine horizontally and alternatively to the second and third magazine to cut the stack of unshuffled playing cards into two unshuffled stacks. Second and third card movers are at the top of the second and third magazines, respectively, for randomly moving individual cards from the top of the stacks of cards in the second and third magazines, respectively, to the first magazine, thereby interleaving the cards to form a vertically registered stack of shuffled cards in the first magazine.

An object of the present invention is to provide an electromechanical card shuffling apparatus for automatically and randomly shuffling multiple decks of playing cards.

Another object of the present invention is to provide an electromechanical card shuffling device for shuffling cards, thereby facilitating and improving the casino playing of wagering games, particularly twenty-one.

Additional objects of the present invention are to reduce dealer shuffling time, thereby increasing the playing time, and to reduce or eliminate problems such as card counting, possible dealer manipulation and card tracking, thereby increasing the integrity of a game and enhancing casino security.

Another object of the present invention is to improve the art of card shuffling by providing a card shuffling machine for randomly shuffling together multiple decks of cards, just as the devices disclosed in U.S. Pat. Nos. 4,807,884 and 5,275,411, the disclosure of which patents is incorporated herein by reference, provide for the automatic, random shuffling of a single deck of playing cards.

A feature of the machine of the present invention is a transparent, machine operated access door for the card shuffling chamber of the machine. An associated advantage is that all the cards are completely visible to players all during the shuffling process.

The present invention includes automatic jammed shuffle detection and rectification features and procedures which are operated and controlled by the microprocessor. Another feature of the present invention is an integral exhaust fan or blower system for keeping the interior surfaces of the machine, including slide surfaces and the photosensors free of dust and cool.

Additional advantages of the shuffling machine of the present invention are that it facilitates and speeds the play of casino wagering games, particularly twenty-one, making the games more exciting for players. It also reduces the effectiveness of card counting or tracking by players by enabling the shuffling of and play from multiple decks of cards.

In use, the machine of the present invention is operated to repeatedly shuffle up to eight decks of playing cards. The access door is opened, and the dealer places the selected number of unshuffled decks in the first, central magazine. The machine is started and, under the control of the integral microprocessor, the machine separates or cuts the unshuffled decks into two unshuffled stacks, one in each of the second and third magazines. The machine then randomly moves individual cards from the top of the stacks in the second and third magazines back to the first magazine, interleaving the cards to form a vertically registered stack of shuffled cards in the first magazine. The machine automatically repeats the shuffling sequence a preprogrammed number of times depending on the number of decks being shuffled.

Other objects, features and advantages of the present invention will become more fully apparent and understood with reference to the following specification and to the appended drawings and claims.

BRIEF DESCRIPTION OF THE DRAWINGS

FIG. 20 and FIGS. 20*a* through 20*e* show a flow diagram depicting the sequence of operations carried out by the electrical control system of the present invention.

DETAILED DESCRIPTION OF THE PREFERRED EMBODIMENT

Figure 1:
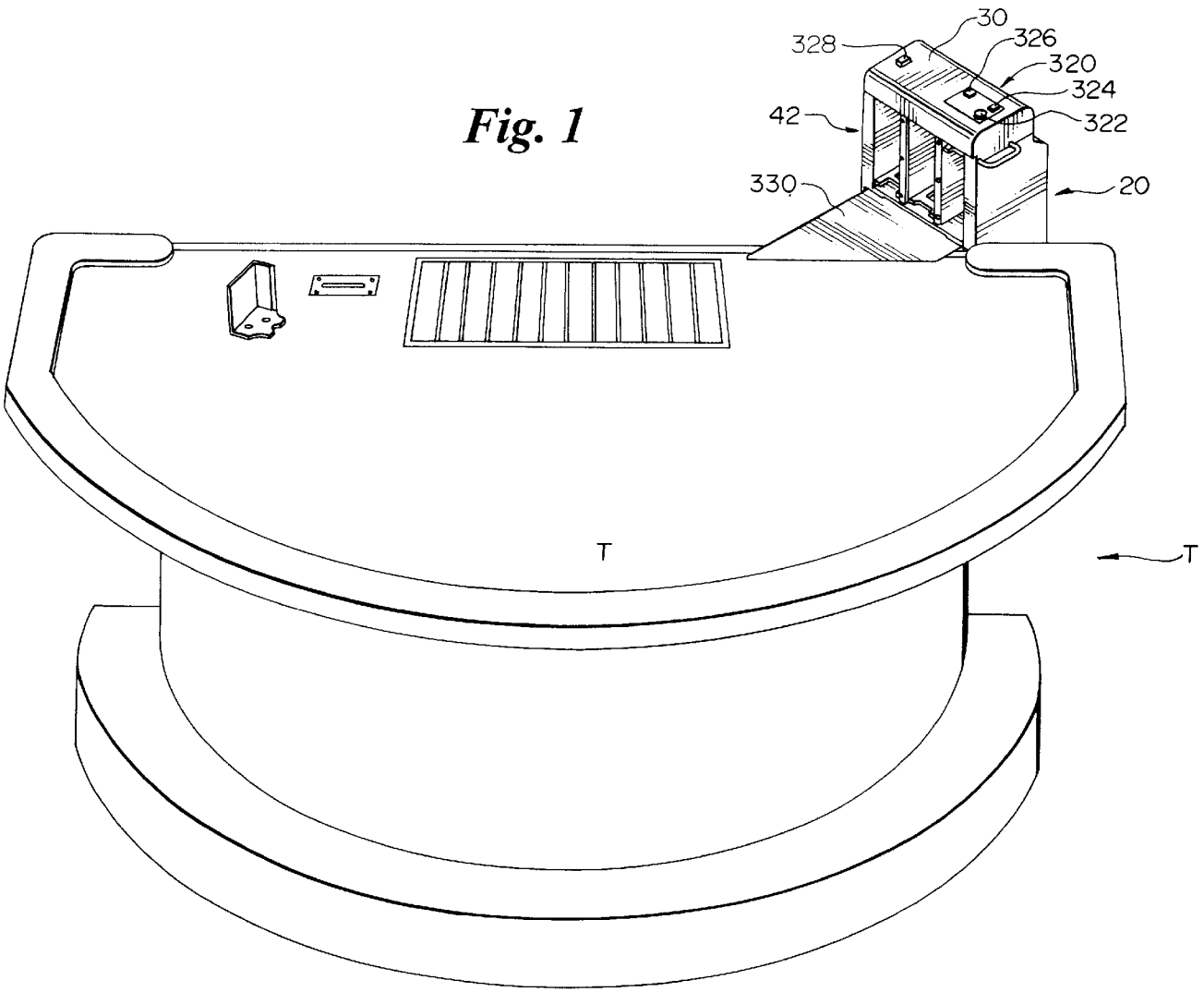
FIG. 1 is a front perspective view depicting the present invention as it might be disposed in a casino adjacent to a gaming table.

This detailed description is intended to be read and understood in conjunction with Appendices A, B, C and D, appended to the end hereof and specifically incorporated herein by reference. Appendix A provides an identification key correlating the description and abbreviation of certain motors, switches and photoeyes or sensors with reference character identifications of the same components in the Figures. Appendix B sets forth steps in the sequence of operations of the shuffling machine in accordance with the present invention. Appendix C describes the homing sequence, broadly part of the sequence of operations, and Appendix D sets forth the manufacturers, addresses and model designations of certain components (motors, limit switches and photoeyes) of the present invention.

With regard to means for fastening, mounting, attaching or connecting the components of the present invention to form the shuffling apparatus as a whole, unless specifically described as otherwise, such means are intended to encompass conventional fasteners such as machine screws, rivets, nuts and bolts, toggles, pins, or the like. Other fastening or attachment means appropriate for connecting components include adhesives, welding and soldering, the latter particularly with regard to the electrical system.

All components of the electrical system and wiring harness of the present invention are conventional, commercially available components unless otherwise indicated. This is intended to include electrical components and circuitry, wires, fuses, soldered connections, circuit boards and control system components.

Generally, unless specifically otherwise disclosed or taught, the materials from which the various components of the present invention, for example the shroud and the plates for forming the frame for supporting the shroud and other components, are selected from appropriate materials such as aluminum, steel, metallic alloys, various plastics, fiberglass or the like. Despite the foregoing indication that components and materials for use in and for forming or fabricating the shuffling machine of the present invention may be selected from commercially available, appropriate items, the Appendices and the following detailed description set forth specific items and steps for use in the present invention, although it is possible that those skilled in the state of the art will be able to recognize and select equivalent items.

Figure 4:
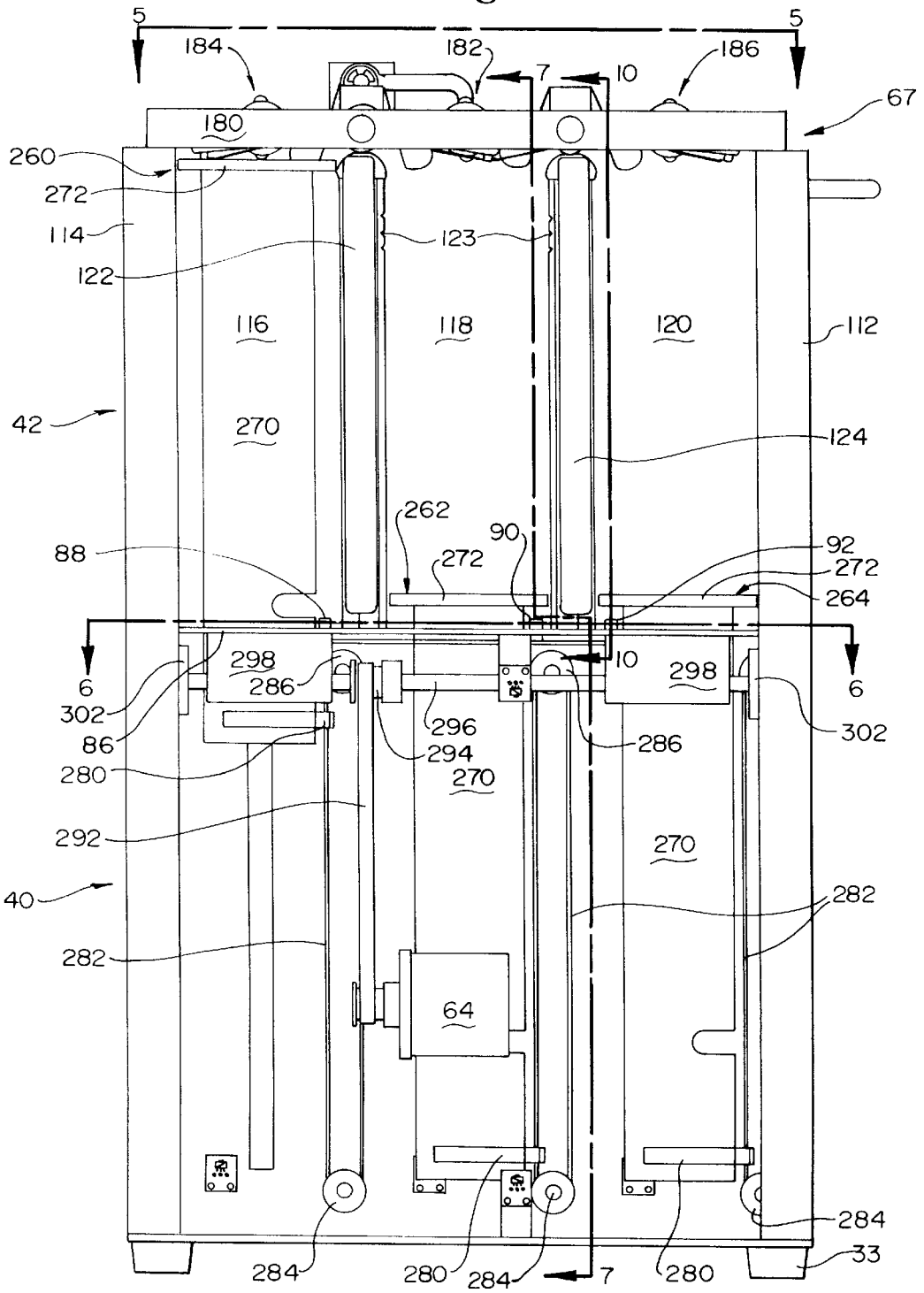
FIG. 4 is a front elevational view of the present invention with the lower front exterior shroud and the clear plastic door of the shuffling chamber removed.
Figure 4A:
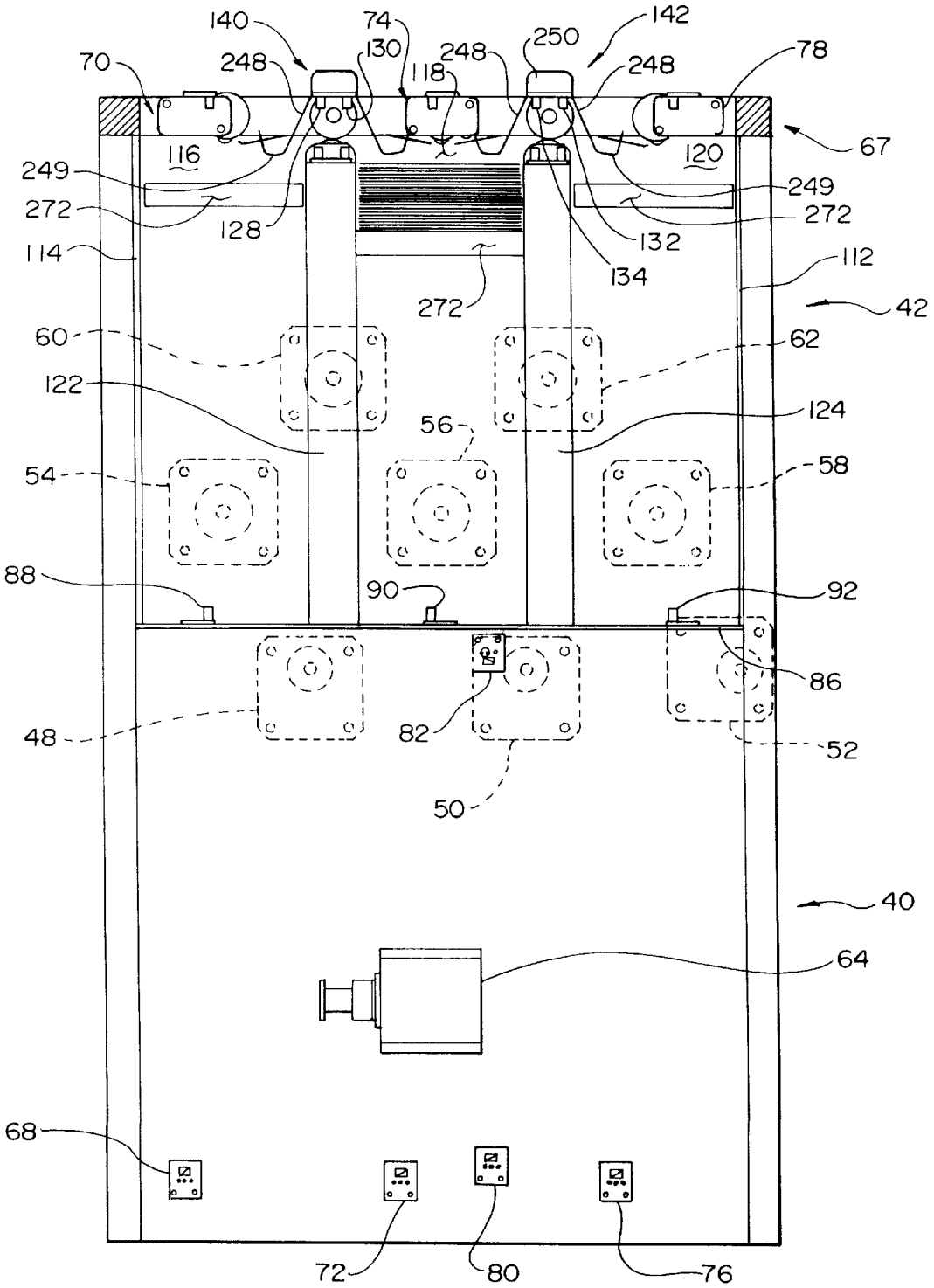
FIG. 4*a* is a front elevational view of the present invention with portions broken away for clarity and with the drive motors shown in phantom.

In the following description, the Appendices and the claims any references to the terms right and left, top and bottom, upper and lower and horizontal and vertical are to be read and understood with their conventional meanings and with reference to viewing the shuffling apparatus from the front as shown in FIGS. 4 and 4*a* and from the player's perspective as the apparatus is disposed in FIG. 1, which is a front perspective view of the machine 20 as it might be disposed in use at a typical casino gaming table T.

Figure 2:
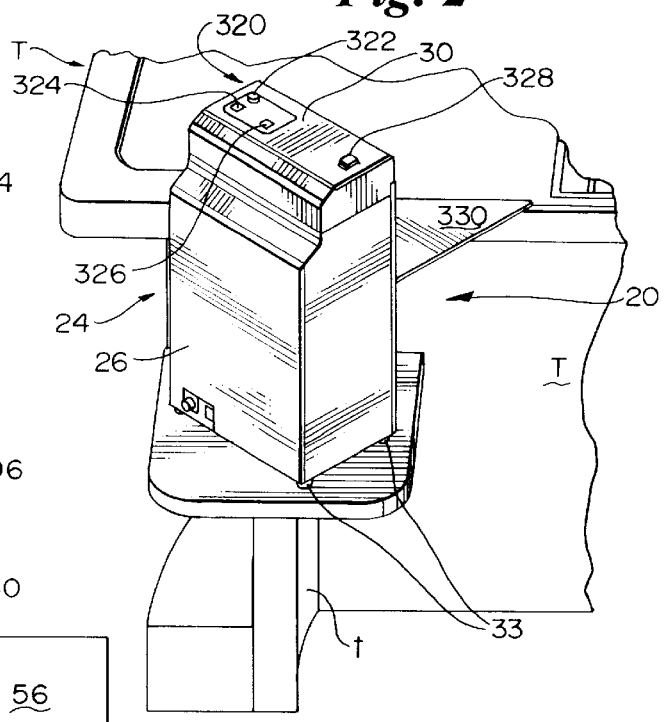
FIG. 2 is a fragmentary perspective view showing the invention from the opposite side of that depicted FIG. 1.
Figure 16:
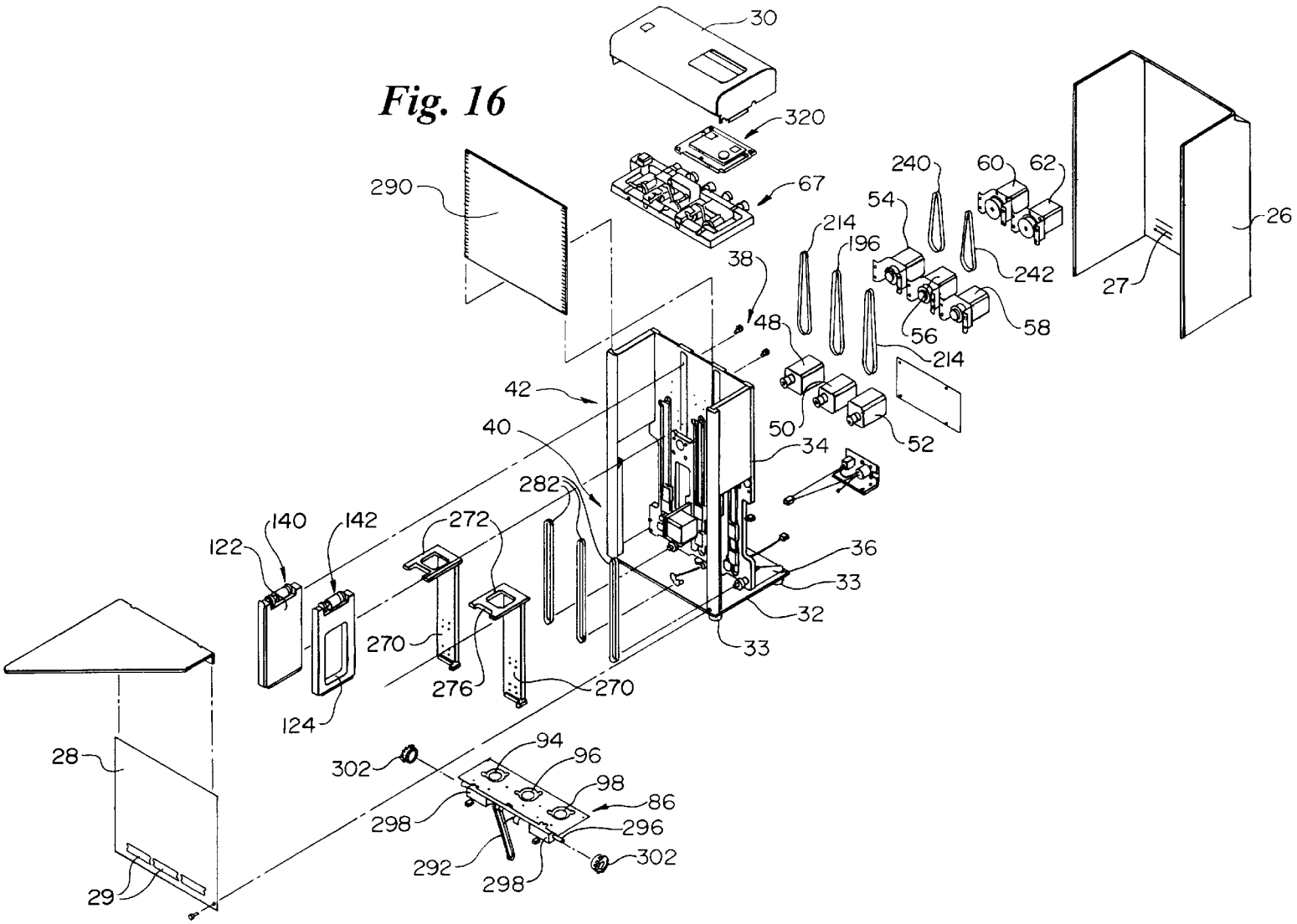
FIG. 16 is an exploded perspective assembly view of the shuffling machine of the present invention showing all of the major component parts or sub-assemblies of the machine.

Referring then to the drawings, particularly FIGS. 1, 2 and 16, the shuffling machine 20 for shuffling together multiple decks of playing cards in accordance with the present invention has an exterior shroud 24 including a rear cover 26 with vents 27, lower front cover 28 with vents 29 and top portion 30. The cover portions forming the shroud 24 are suitably mounted on a supporting framework comprising a flat, generally horizontal base 32 carrying four non-slip feet 33 on its underside and a vertically oriented and extending main base plate 34 fixedly and generally perpendicularly attached to the base 32 and supported by a pair of support brackets 36.

Together the shroud 24 and the framework define the three broad operating chambers of the machine 20: a rear drive and control chamber 38, a lower, front door and elevator transmission chamber 40, and a card-receiving shuffling chamber 42.

Figure 3:
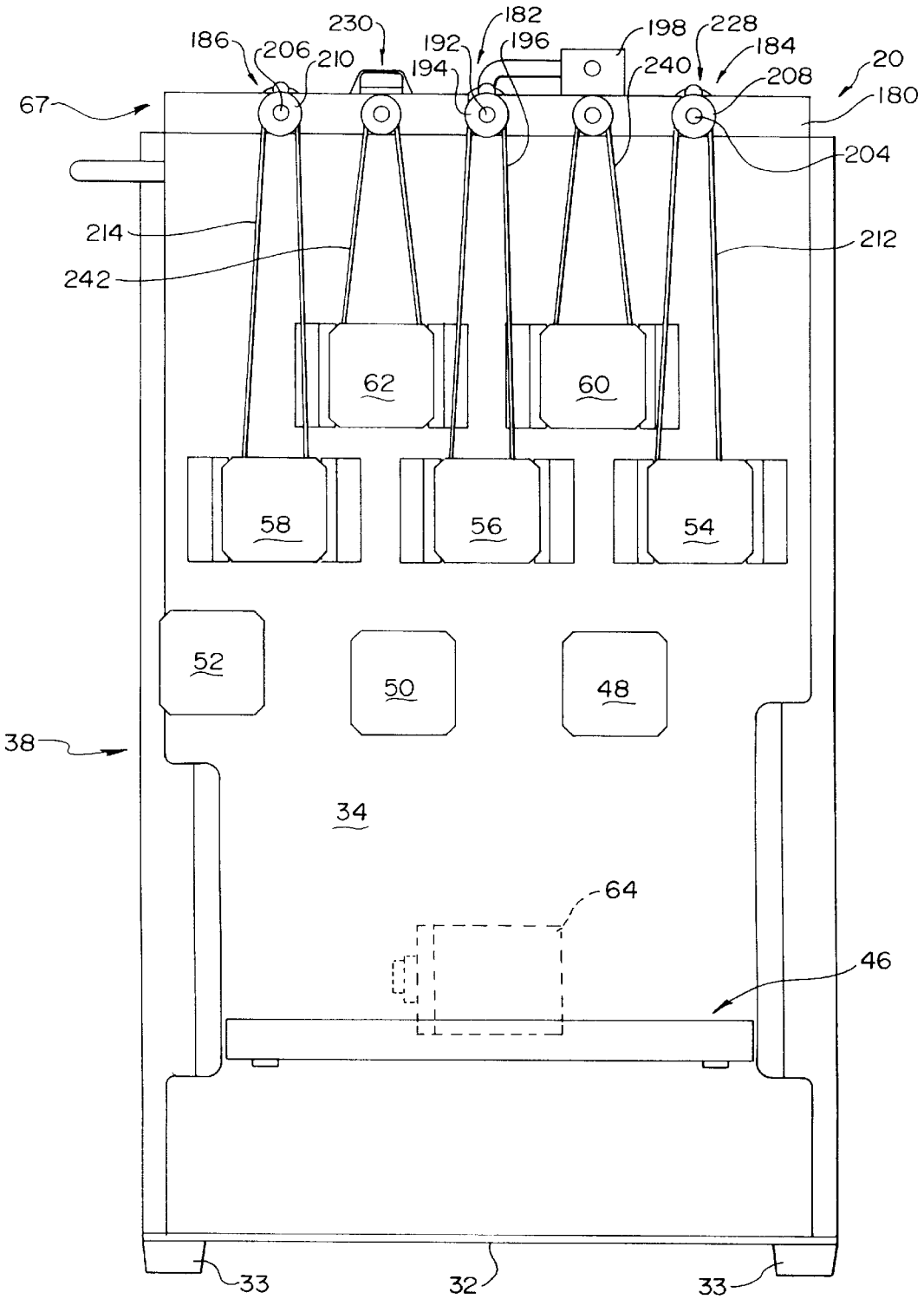
FIG. 3 is a rear elevational view of the shuffling machine of the present invention with the exterior shroud removed.

With continued reference to FIG. 16, and to FIGS. 3 and 4*a*, the rear chamber 38 houses the control system 46 for controlling and operating the machine 20 and a plurality of stepper motors, as set forth in Appendix D. The motors include a left elevator motor 48, a center elevator motor 50 and a right elevator motor 52. A second set or bank of stepper motors is attached to the main base plate 34 and includes a left feed motor 54, a center feed motor 56 and a right feed motor 58. A left speed-up stepper motor 60 and a right speed-up motor 62 are also mounted on the main base plate 34. A door operating stepper motor 64, shown in phantom in FIG. 3, is attached to the front of the main base plate 34 in the lower front chamber 40.

Figure 17:
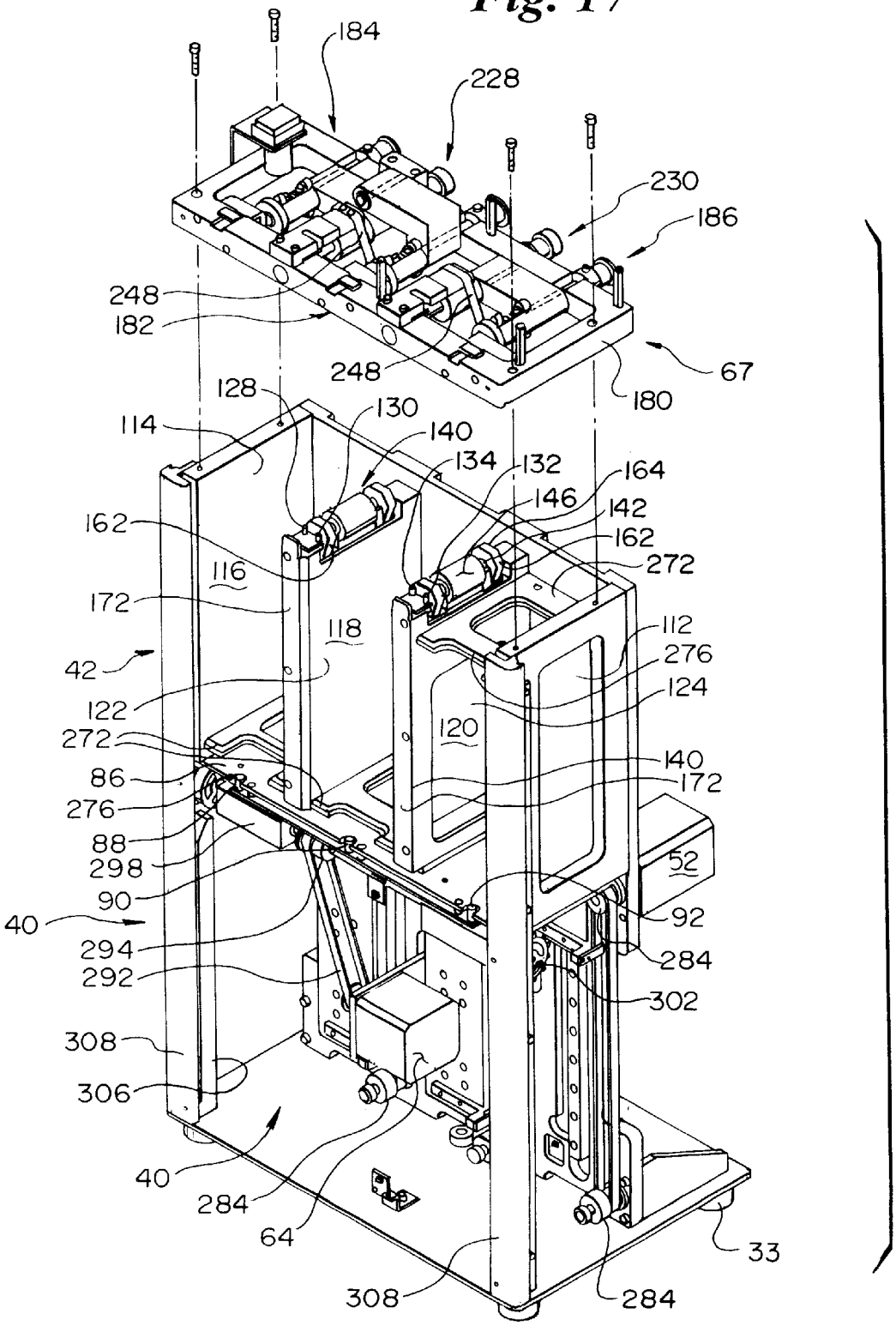
FIG. 17 is a partially exploded perspective view depicting the assembly of portions of the shuffling machine of the present invention.
Figure 18:
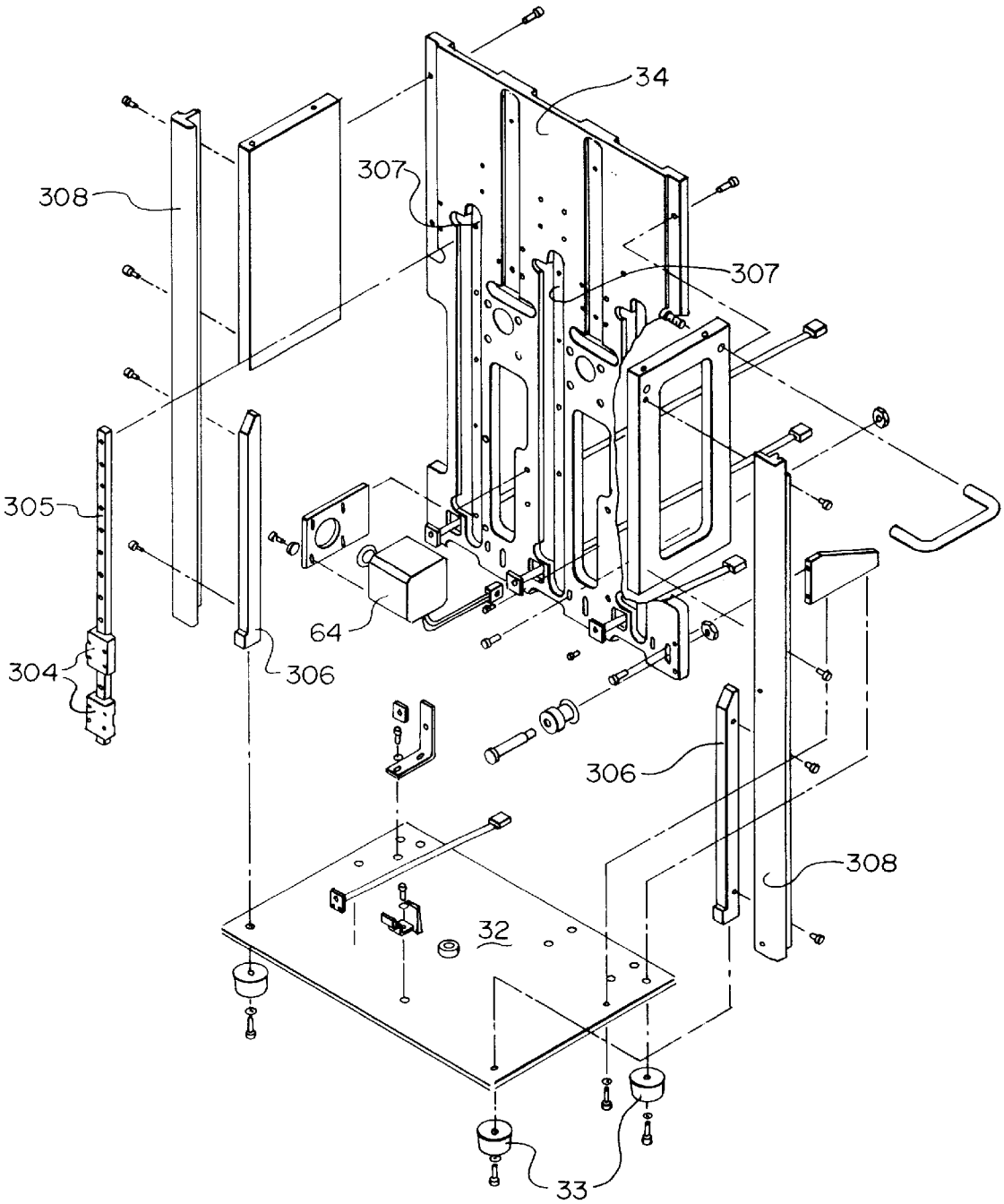
FIG. 18 is an exploded perspective view depicting the transport assembly exclusive of the transport rollers at the top of the shuffling machine, and specifically shows the shuffling chamber.

Referring to FIGS. 4, 4*a* and 17, in the lower front chamber 40 the main base plate 34 carries a plurality of limit switches, including a left elevator bottom limit switch 68, a center elevator bottom limit switch 72 and a right elevator bottom limit switch 76. At the top of the shuffling chamber 42, a transport assembly, indicated generally at 67, carries corresponding elevator limit switches including a left elevator top limit switch 70, a center elevator top limit switch 74 and a right elevator top limit switch 78. Door bottom and door top limit switches, 80, 82, respectively, are mounted in the lower front chamber 40.

Referring to FIGS. 4, 4*a*, 6 and 17, a horizontal central, generally flat floor plate assembly 86 separates the lower front chamber 40 from the shuffling chamber 42, defining the bottom floor of the shuffling chamber 42. The floor plate assembly 86 carries a left elevator empty photoeye 88 (the term photoeye is intended to be synonymous with photosensor and optical sensor), a center elevator empty photoeye 90 and a right elevator empty photoeye 92. The floor plate assembly 86 also carries three fans, a left magazine fan 94, a center magazine fan 96 and a right magazine fan 98, each including a motor 100 and concentric blades 102.

Figure 8:
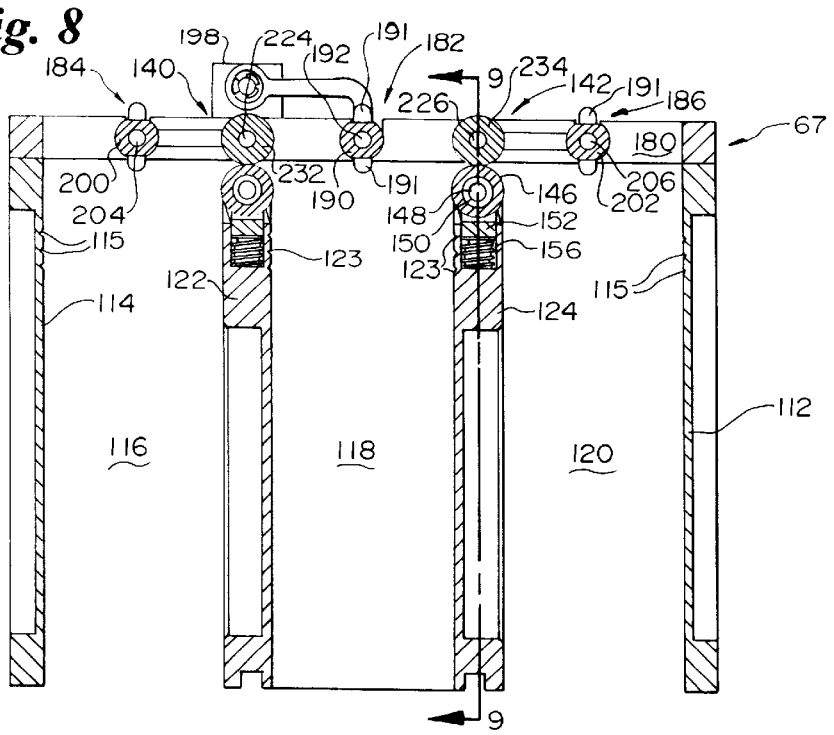
FIG. 8 is a sectional elevation view taken along line 8—8 in FIG. 4.
Figure 9:
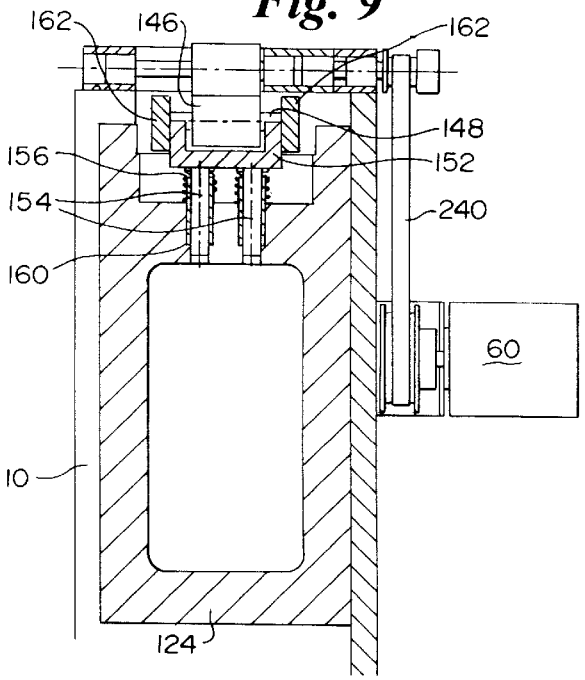
FIG. 9 is a sectional elevation view taken along line 9—9 in FIG. 8.
Figure 10:
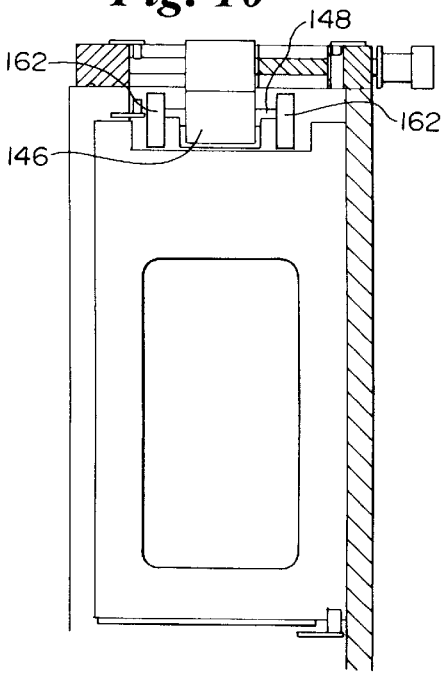
FIG. 10 is a sectional elevation view taken along line 10—10 in FIG. 4.
Figure 11:
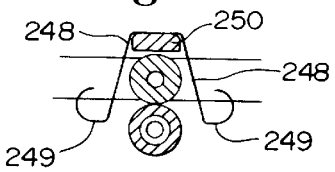
FIG. 11 is a sectional elevation view taken along line 11—11 in FIG. 5.

With reference to FIGS. 4, 4*a*, 5 and 17, the top of the shuffling chamber 42 includes the transport assembly 67. The outer sides of the chamber 42 are formed by a pair of parallel side plates 112, 114. Adjacent to their upper inside edge, each plate 112, 113 carries at least one card stopping groove 115 (see FIG. 8). Preferably three parallel grooves are provided. The grooves help ensure that cards come to rest horizontally and face-down in the chamber 42. The chamber 42 is divided into three adjoining, vertically extending card magazines, a left magazine 116, a center magazine 118 and a right magazine 120 by two substantially similar left and right center magazine plate assemblies 122, 124, respectively. Adjacent to the upper edges of the sides of the plate assemblies 122, 124, on the side facing into the center magazine 118 are card stopping grooves 123. The left plate assembly 122 carries a left outer counter photoeye 128 and a left inner counter photoeye 130. Similarly, the right plate assembly 124 carries a right outer counter photoeye 132 and a right inner counter photoeye 134. With continuing reference to FIG. 17, and to FIGS. 8–10, each of the left and right center plate assemblies 122, 124 carries a floating pinch roller assembly 140, 142 centered on its top edge. Both roller assemblies 140, 142 are substantially identical so only the right roller assembly 142 will be described. The assembly 142 includes a non-driven or idler pinch roller 146 supported on a shaft 148 and by a set of typical roller bearings 150. As shown in FIG. 9, the roller 146, shaft 148 and bearing 150 assembly is received in and supported by a spring block 152, in turn mounted on a pair of linear pinch roller shafts 154, each concentrically within a coil springs 156. This assembly is received by bushings 160 in the upper region of the plate assembly 142. The spring block 152 also carries a pair of card guides 162 with uppermost rounded shoulders 164, each being fixedly attached adjacent to the ends of the spring block 152. Along the forward facing edge of the plate assemblies 122, 124, a wire housing channel 170 (see FIG. 9), covered by a wire cover 172, is provided to receive a wire (not shown) which operably couples the card gap counting optical sensors or photoeyes 128, 130, 132, 134 to the control system 46.

Figure 5:
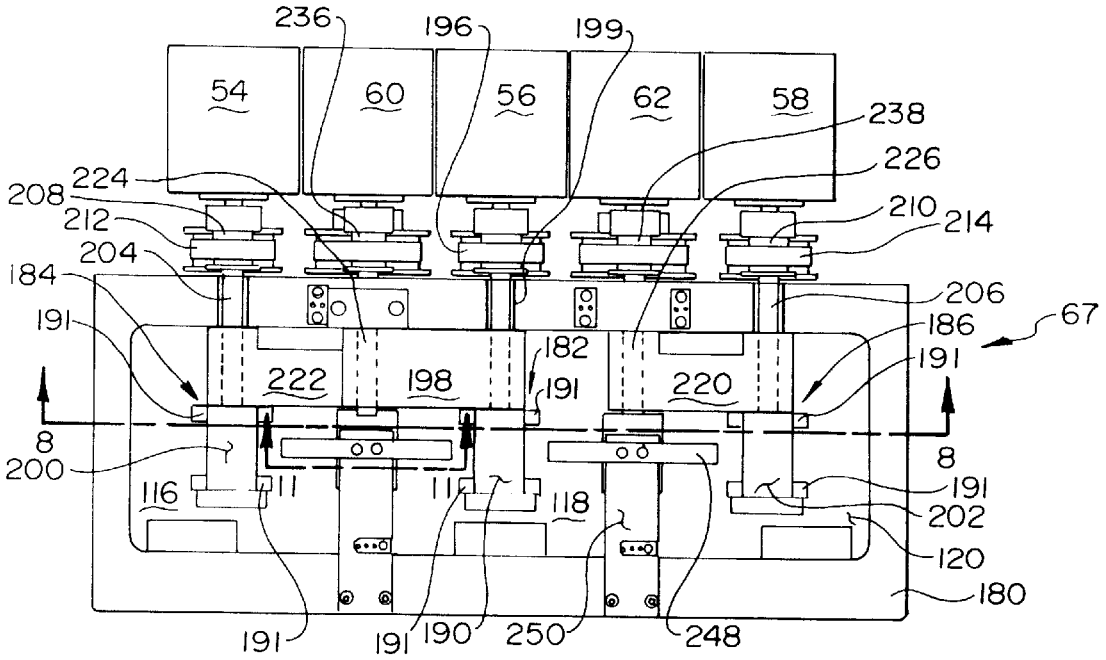
FIG. 5 is a top plan view taken along line 5—5 in FIG. 4.
Figure 6:
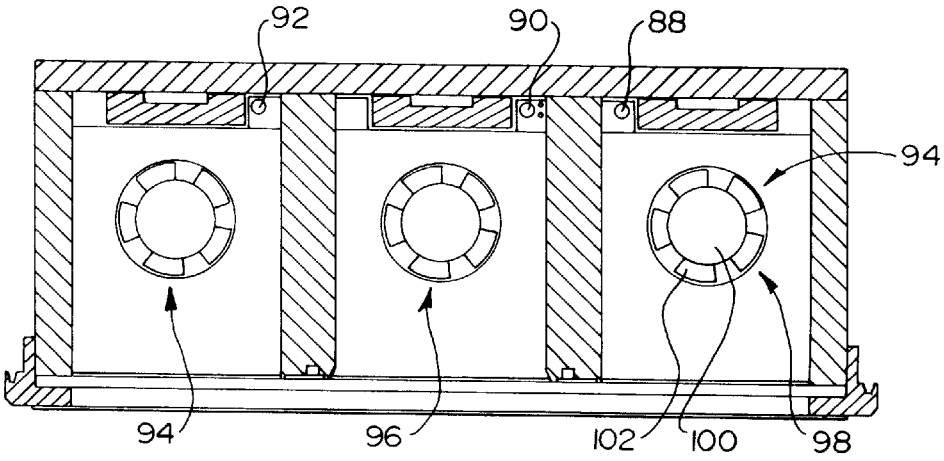
FIG. 6 is a sectional plan view taken along line 6—6 in FIG. 4.

Referring to FIGS. 3, 4, 5, 7, 8 and 11, as well the assembly drawing FIG. 17, the transport assembly 67 is mounted at the top of the side plates 112, 114 and effectively closes or defines the upper region of the shuffling chamber 42. The transport assembly 67 comprises a bearing plate 180 and three card moving pickoff assemblies including a center pickoff assembly 182, a left side pickoff assembly 184 and a right side pickoff assembly 186. As shown in FIG. 5, the pickoff assemblies are generally centrally positioned above the open top of each respective magazine. The center pickoff assembly 182, including a pickoff roller 190 carrying at least two sticky pickoff fingers or tabs 191 one hundred-eighty degrees apart, is connected to a center driven pulley 194 and, (referring to FIG. 3) via a belt 196, to the center feed motor 56. The shaft 192 extends through a center pickoff rocker block 198 pivotally mounted on the bearing plate 180, and its ends rest in an open-topped channel 199 in the bearing plate 180 (see FIG. 5).

Similarly, each of the left and right pickoff assemblies 184, 186 include a pickoff roller 200, 202, respectively, carrying pickoff tabs 191. The rollers 200, 202 are mounted on shafts 204, 206, respectively connected to driven pulleys 208, 210 and, via belts 212, 214, to the left and right feed motors 54, 58. The shafts 204, 206 extend through rocker blocks 220, 222 which are pivotally mounted on the fixed shafts 224, 226 of the speed-up assemblies 228, 230.

Each speed-up assembly 228, 230 includes a driven, floating speed-up roller 232, 234, respectively, fixed on a shaft 224, 226. Each roller 232, 234 is above and aligned with the rollers 146 of the pinch roller assemblies 140, 142. The shafts 224, 226 are coupled to speed-up pulleys 236, 238, in turn coupled to the speed-up motors 60, 62 via belts 240, 242.

Referring to FIGS. 4, 4*a*, 5, 11 and 17, the transport assembly 67 includes a plurality of leaf-spring card deflectors 248 fixedly mounted on spring blocks 250. The deflectors 248 are generally over the speed-up assemblies 228, 230 and the arms 249 of the defectors extend generally downwardly into the magazines 116, 118, 120 to contact cards moving in the cutting and shuffling movements described below, thereby directing cards into proper position in the magazines and helping to avert jams in the shuffling process. It should be understood that block-type deflectors (not shown) with appropriately curved or angled surfaces could be mounted on the transport assembly 67 and substitute for or be used in conjunction with the spring deflectors 248 depicted.

Figure 7:
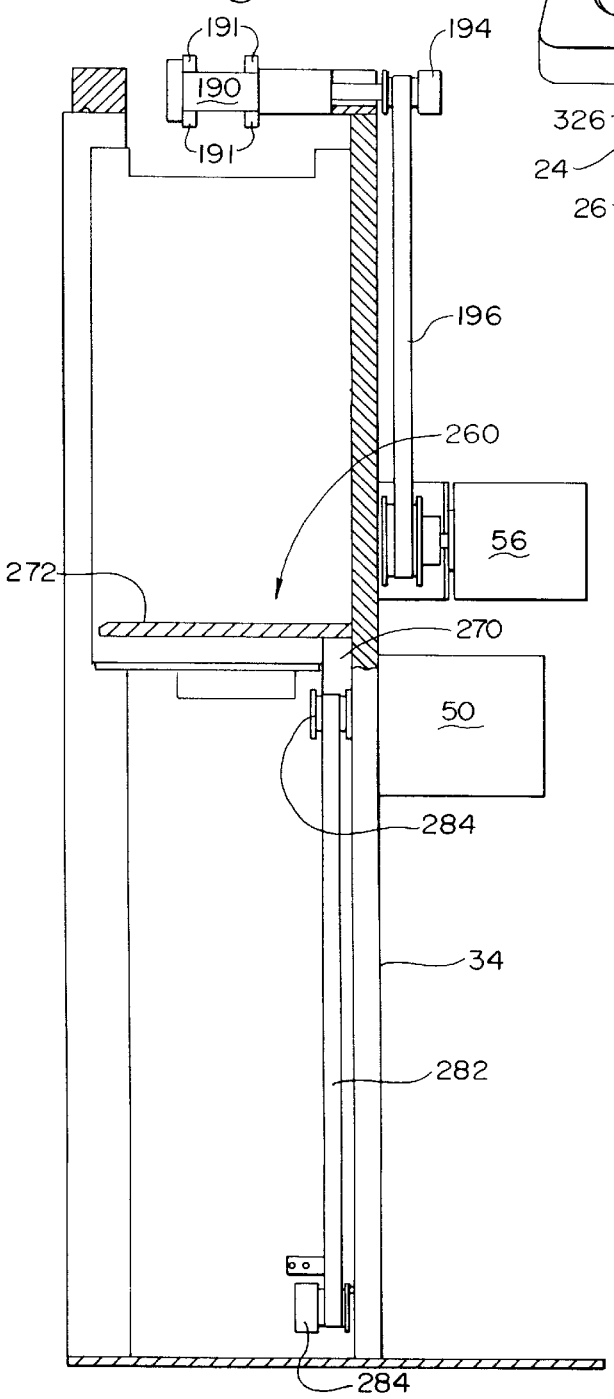
FIG. 7 is a sectional elevation view taken along line 7—7 in FIG. 4.

Referring to FIGS. 4, 4*a*, 7, 16, 17 and 18, each magazine 116, 118, 120 contains a vertically movable elevator 260, 262, 264, respectively. The elevators 260, 262, 264 are substantially similar comprising a vertically disposed platform mount 270 and a generally horizontal platform 272. The platform mount 270 for each elevator 260, 262, 264 is mounted on a pair of vertically spaced mounting brackets 304, in turn slidably received on elevator track 305. The track 305 is fixed to base plate 34 in track receiving grooves 307 (see FIG. 18). The platforms 272 of the elevators 260, 264 are substantially identical, each having a generally U-shaped relieved area 276 on its forward facing leading edge, but the U-shaped area on the leading edge of the platform of the center elevator 262 extends more deeply rearwardly into the platform 272. Each platform 272 carries a belt clamp assembly 280 beneath and adjacent to its lower edge. The belt clamp assembly 280 (best seen in FIG. 4) is damped to elevator belts 282, as best seen in FIGS. 7 and 4. The belts 282 extend around idler pulleys 284 mounted on the main base plate 34. The belts 282 are coupled to drive pulleys 286, in turn and respectively connected to the elevator motors 48, 50, 52 (FIG. 3).

With reference to FIGS. 16, 17, 18 and 4, the lower front chamber 40 houses an operating mechanism for the transparent front shuffling chamber door 290, including the motor 64 operably linked via belt 292 to a door pulley 294 keyed to a door shaft 296 supported by a pair of door shaft bearing blocks 298. The bearing blocks 298 support or contain a set of conventional roller bearings (not shown). Referring to FIGS. 16 and 17, each end of the door shaft 296 carries a pinion wheel 302. The sides of the door 29 are provided with a plurality of in-line holes to receive the pinions, 302, respectively, and a pair of door blocks 306 is connected to the T-shaped columns 308 of the framework of the machine 20 to support and guide the door 290 as it travels up and down.

Referring to FIGS. 1, 2 and machine assembly FIG. 16, controls 320 for operating the shuffling machine 20 are mounted between the transport assembly 67 and the top portion 30 of the shroud 24. The controls 320 include an alarm light 322, an open door command button 324, a reset command button 326 and a start button 328.

Figure 12:
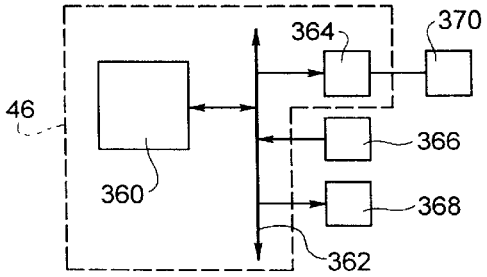
FIG. 12 is a schematic diagram of the electrical control system.

FIG. 12 shows a block diagram depicting the electrical control system in one embodiment of the present invention. The control system includes a controller 360, a bus 362, and a motor controller 364. Also represented in FIG. 12 are inputs 366, outputs 368, and a motor system 370. The controller 360 sends signals to both the motor controller 364 and the outputs 368 while monitoring the inputs 366. The motor controller 364 interprets signals received over the bus 362 from the controller 360. The motor system 370 is driven by the motor controller 364 in response to the commands from the controller 360. The controller 360 controls the state of the outputs 368 by sending appropriate signals over the bus 362.

In the preferred embodiment of the present invention, the motor system 370 comprises nine motors that are used for operating the multi-deck shuffler 20. Three elevator motors 48, 50, 52 drive the left, center, and right elevators 260, 262, 264; three feed motors 54, 56, 58 drive the left, center, and right feed rollers 200, 190, 202; and two motors 60, 62 drive the left and right speed-up rollers 232, 234. A ninth motor 64 is used to open and close the door. In such an embodiment, the motor controller 364 would normally comprise one or two controllers and driver devices for each of the nine motors described above. However, other configurations are obviously possible.

The outputs 368 include the alarm, start, and reset indicators described above and may also include signals that can be used to drive a display device (e.g., a seven segment display—not shown). Such a display device can be used to implement a timer, a card counter, or a shuffle counter. Generally, an appropriate display device can be used to display any information worthy of display.

The inputs 366 are signals from the limit switches, photoeyes, and buttons described herein. The controller 360 receives the inputs 366 over the bus 362.

Figure 13:
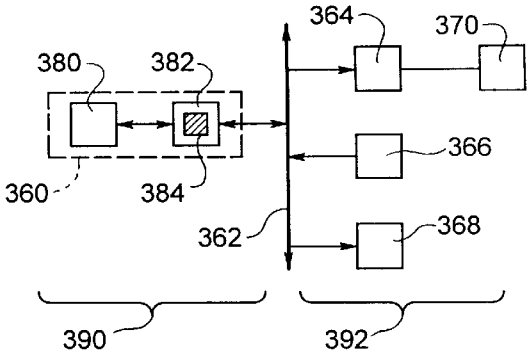
FIG. 13 is a schematic diagram of the electrical control system.

Although the controller 360 can be any digital controller or microprocessor-based system, in the preferred embodiment, the controller 360 comprises a processing unit 380 and a peripheral device 382 as shown in FIG. 13. The processing unit 380 in the preferred embodiment is an 8-bit single-chip microcomputer such as an 80C52 manufactured by the Intel Corporation of Santa Clara, Calif. The peripheral device 382 is a field programmable microcontroller peripheral device that includes programmable logic devices, EPROMs, and input-output ports. As shown in FIG. 13, peripheral device 382 interfaces the processing unit 380 to the bus 362.

The series of instructions stored in the controller 360 is shown in FIG. 13 as program logic 384. In the preferred embodiment, the program logic 384 is RAM or ROM hardware in the peripheral device 382. (Since the processing unit 380 may have some memory capacity, it is possible that some of the instructions are stored in the processing unit 380.) As one skilled in the art will recognize, various implementations of the program logic 384 are possible. The program logic 384 could be either hardware, software, or a combination of both. Hardware implementations might involve hardwired controller logic or instructions stored in a ROM or RAM device. Software implementations would involve instructions stored on a magnetic, optical, or other media that can be accessed by the processing unit 380.

It is possible in some environments for a significant amount of electrostatic energy to build up in the shuffling machine 20. Significant electrostatic discharge can affect the operation of the machine 20 and perhaps even cause a hazard to those near the machine 20. It is therefore helpful to isolate some of the circuitry of the control system from the rest of the machine. In the preferred embodiment of the present invention, a number of optically-coupled isolators are used to act as a barrier to electrostatic discharge.

Figure 14:
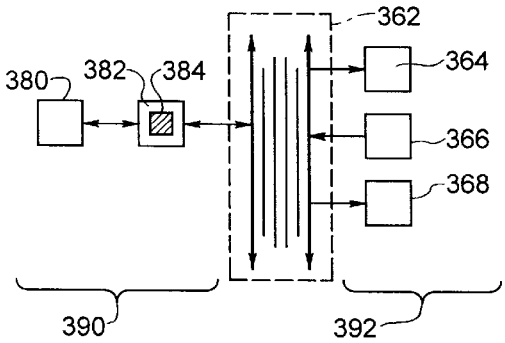
FIG. 14 is a schematic diagram of the electrical control system with an optically-isolated bus.
Figure 15:
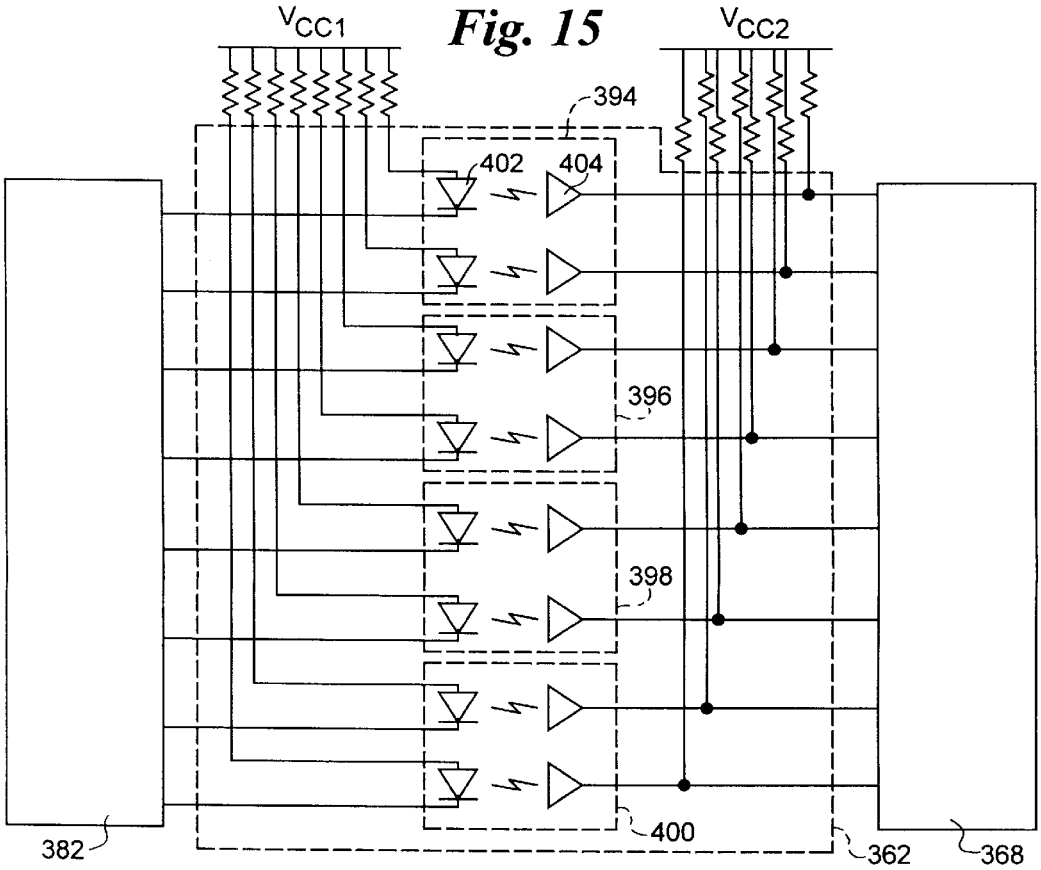
FIG. 15 is a detailed schematic diagram of a portion of FIG. 14.

As shown in FIG. 14, a first group of circuitry 390 can be electrically isolated from a second group of circuitry 392 by using optically-coupled logic gates that have light-emitting diodes to optically (rather than electrically) transmit a digital signal, and photodetectors to receive the optically-transmitted data. An illustration of the electrical isolation through the use of optically-coupled logic gages is shown in FIG. 15, which shows a portion of FIG. 14 in detail. Four Hewlett Packard HCPL-2630 optocouplers (labeled 394, 396, 398, and 400) are used to provide an 8-bit isolated data path to the output devices 368. Each bit of data is represented by both an LED 402 and a photodetector 404. The LEDs emit light when forward biased, and the photodetectors detect the presence or absence of the light. Data is thus transmitted without an electrical connection.

FIGS. 1 and 2 depict a typical installation of the machine 20 of the present invention. Typically the machine 20 will be supported on a pedestal type table, t, located immediately adjacent to and behind a typical gaming table, T. The shroud 24 includes an adapting flange 330. The flange 330 helps connect the machine 20 to the gambling table, T, to reduce the chance that a dealer standing generally centrally behind the table T with the machine 20 on his left will drop cards between the table and the apparatus 20 to the floor. FIG. 2 shows the location of the power connection 332 for the machine 20.

The following description of the use and operation of the machine 20 of the present invention should be read and understood in conjunction with Appendix B which outlines the sequence of operation of the machine 20 and correlates the operative steps with the state of the various motors, sensors and other components of the machine 20. In use, the power is turned on and the machine 20 goes through the homing sequence (set forth in Appendix C). When the start button lights, the dealer loads a selected number of decks of cards, up to eight decks, into the center magazine. The cards should be pushed all the way into the back of the magazine; the U-shaped relieved area 276 in the forward or leading edge of the elevator platform 272 assists the dealer in accomplishing this. The start button is pushed to initiate the shuffling sequence and, after a three to four second delay, the dear plastic door moves upwardly closing the shuffling chamber.

Figure 19:
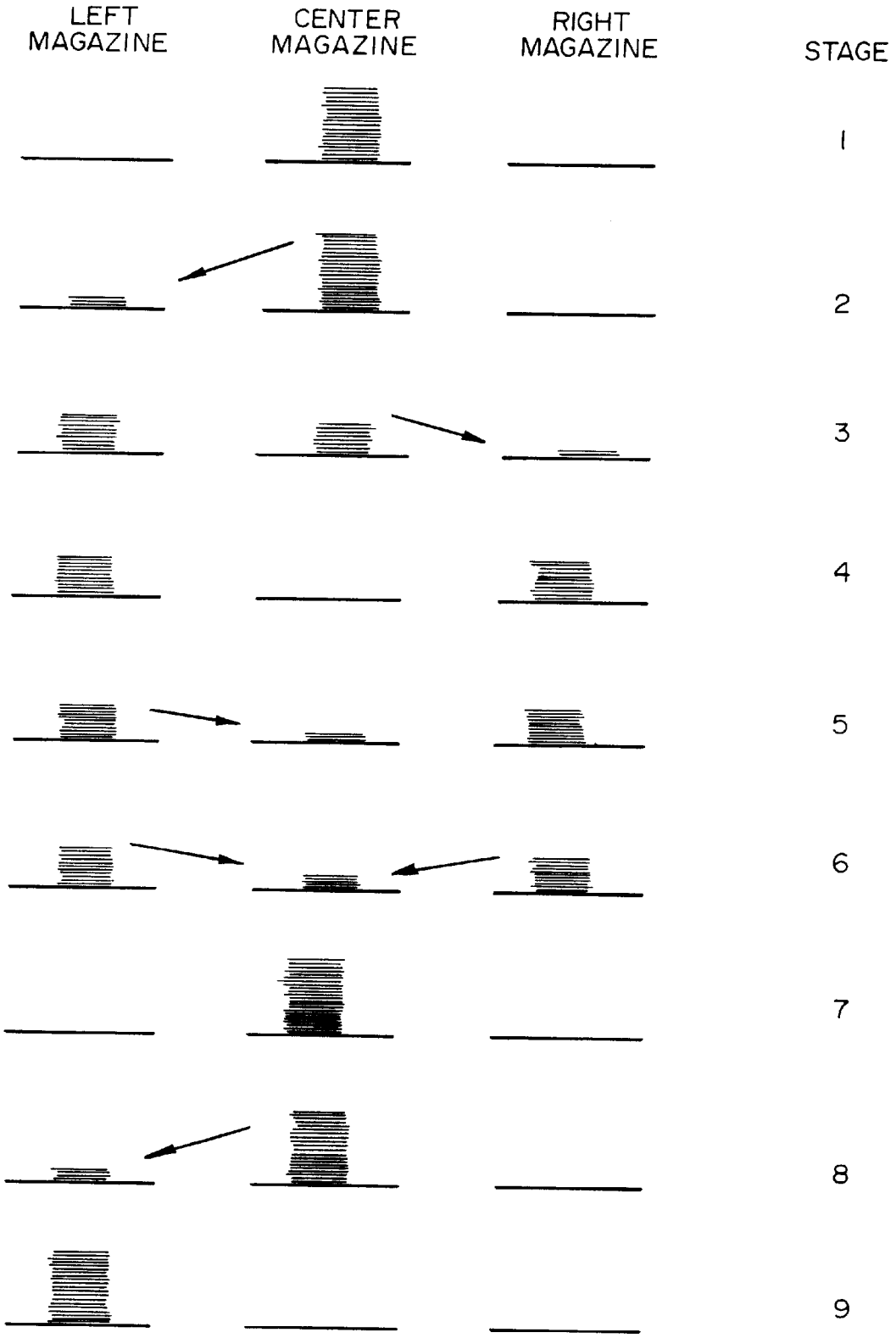
FIG. 19 shows a series of stages that illustrate the movement of cards in one embodiment of the present invention.

The cutting and shuffling operations are then carried out, as shown in the various stages of operation shown in FIG. 19. Stage 1 of the sequence shows the cards in their starting position in the center magazine. The cards are initially moved to the left magazine as shown in stage 2. After roughly half of the cards (e.g., 45%–55%) are moved to the left magazine, the remaining cards in the center magazine are then moved to the right magazine. Stage 4 shows the state of the machine 20 after the cutting phase of the sequence of operations has been completed.

A clump of cards (e.g., 5 to 50 cards) from the left magazine is then moved into the center magazine. After this clump of cards moves into the center magazine, cards from the right magazine also begin moving into the center magazine so that cards from both the left and right magazines are simultaneously being moved into the center magazine. The cards are thereby shuffled into the center magazine. The shuffled deck is shown in FIG. 19 as stage 7.

The clump of cards is moved from the left magazine to the center magazine before any cards are moved from the right magazine to ensure that both the top and bottom cards are buried in the deck after the shuffling operation. Since the card order is reversed when cards are transferred from one magazine to another, the top card in the center magazine at stage 1 will normally be the bottom card in the left magazine at stage 4. Similarly, the bottom card in the center magazine at stage 1 will normally be the top card in the right magazine at stage 4. To ensure that these cards are buried in the deck at stage 7, cards from the left magazine are moved into the center magazine before the top card from the right magazine is moved into the center magazine. This ensures that the bottom card in stage 1 is not again the bottom card at stage 7. And since cards are taken first from the left magazine, the left magazine will very likely be empty before the right magazine. If the left magazine does empty first, the top card in stage 2 will not be the top card in stage 7.

Stages 2–7 are repeated a random number of times (e.g., four to seven times) to ensure that the cards are thoroughly shuffled. For four decks, 4–6 cycles are appropriate, and for six or eight decks, 5–7 cycles may be appropriate. After stage 7 is completed for the final time, the cards are moved into the left magazine (stages 8 and 9) for removal. The start light lights again, indicating that the cycle is complete. The dealer presses the start button and the door opens downwardly. Unshuffled decks may be loaded into the center magazine, and the shuffled decks are removed for use. After three to four seconds, the door will automatically dose and the machine starts another shuffle automatically.

The foregoing sequence of operations is carried out under the control of the electrical control system 46. The electrical control system 46 controls and/or monitors the photoeyes, the stepper motors, limit switches and display devices. The sequence of operations carried out by the electrical control system are set forth in FIG. 20.

Figure 20:
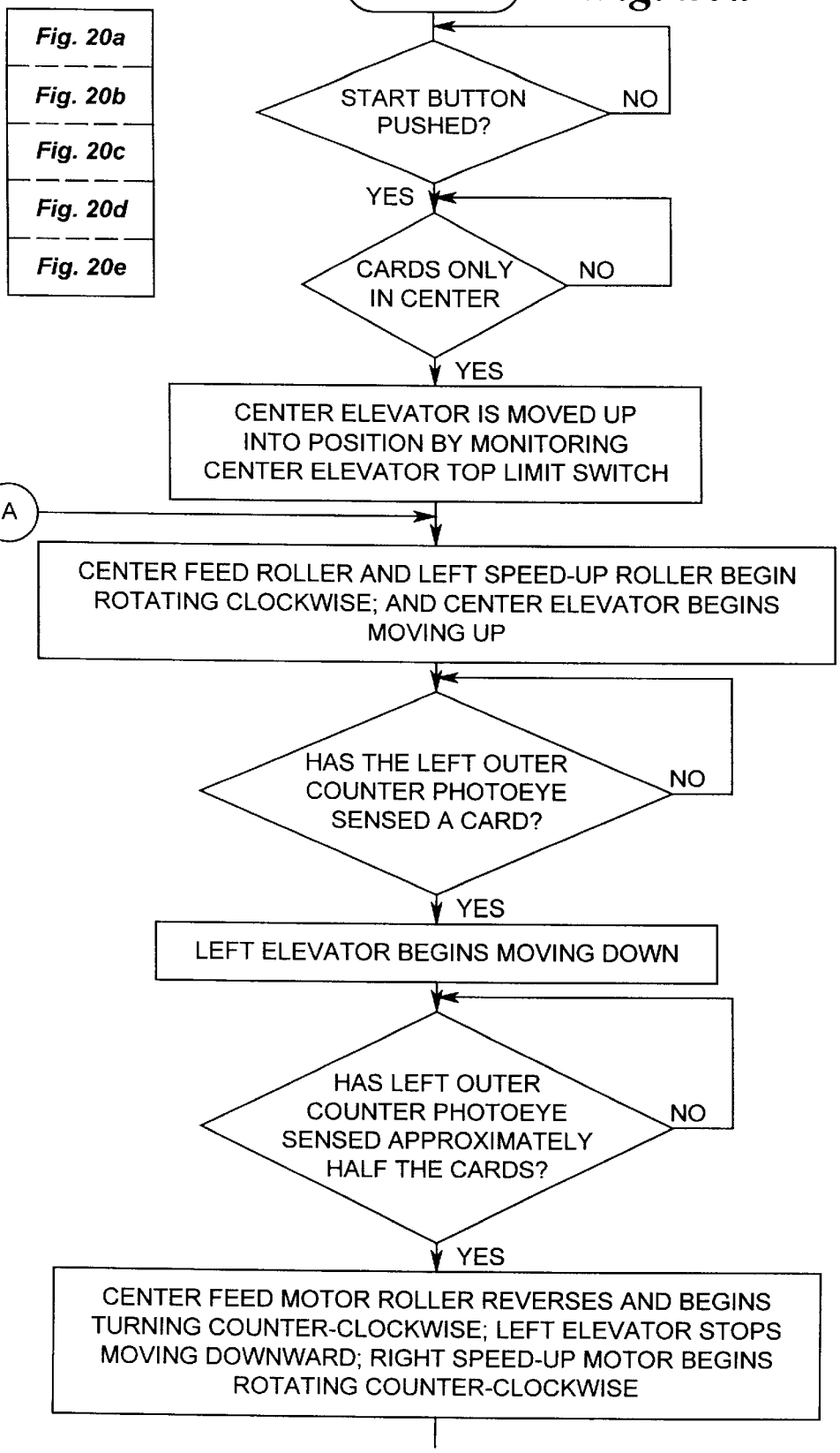
Figure 20B:
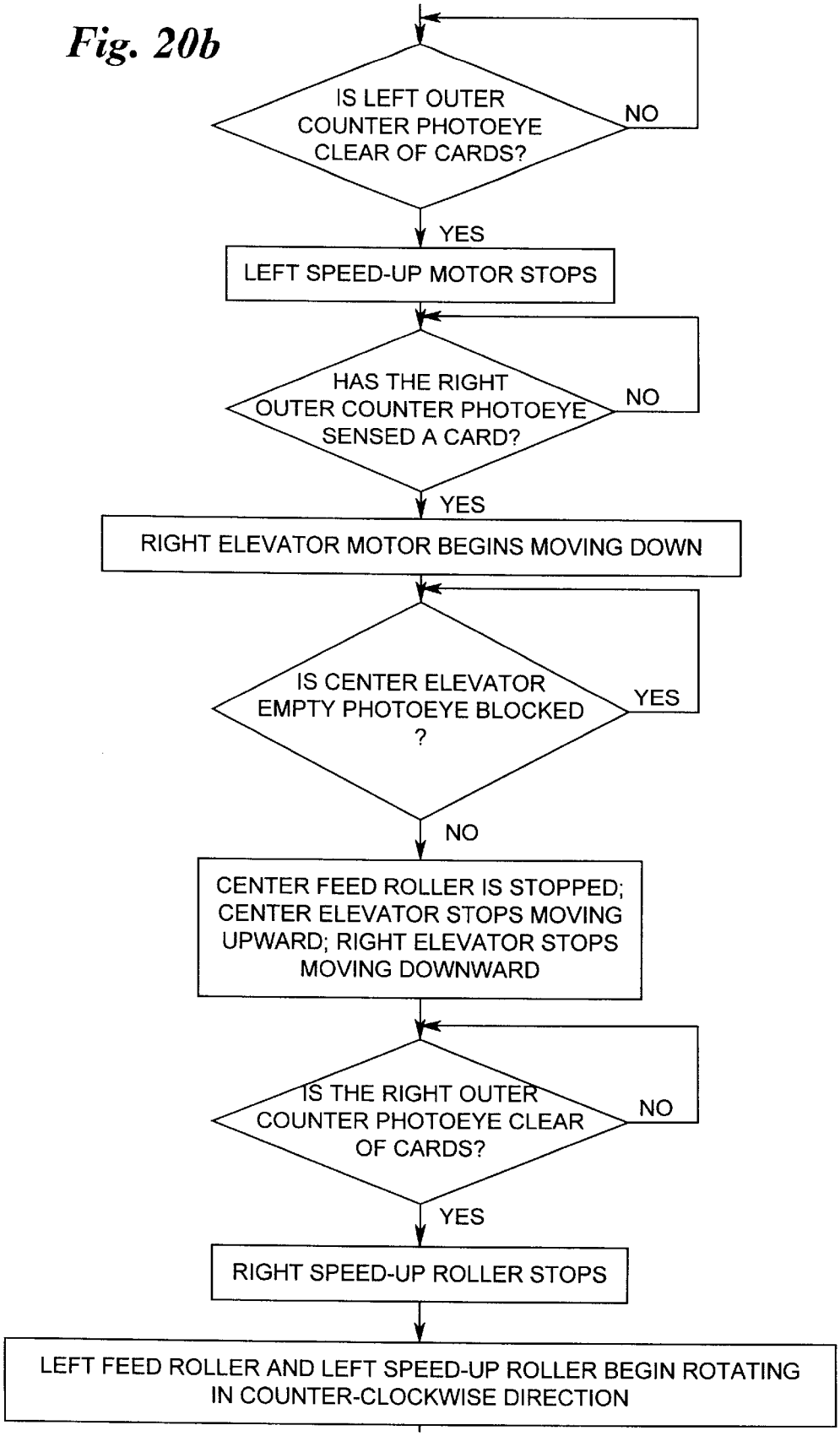
Figure 20C:
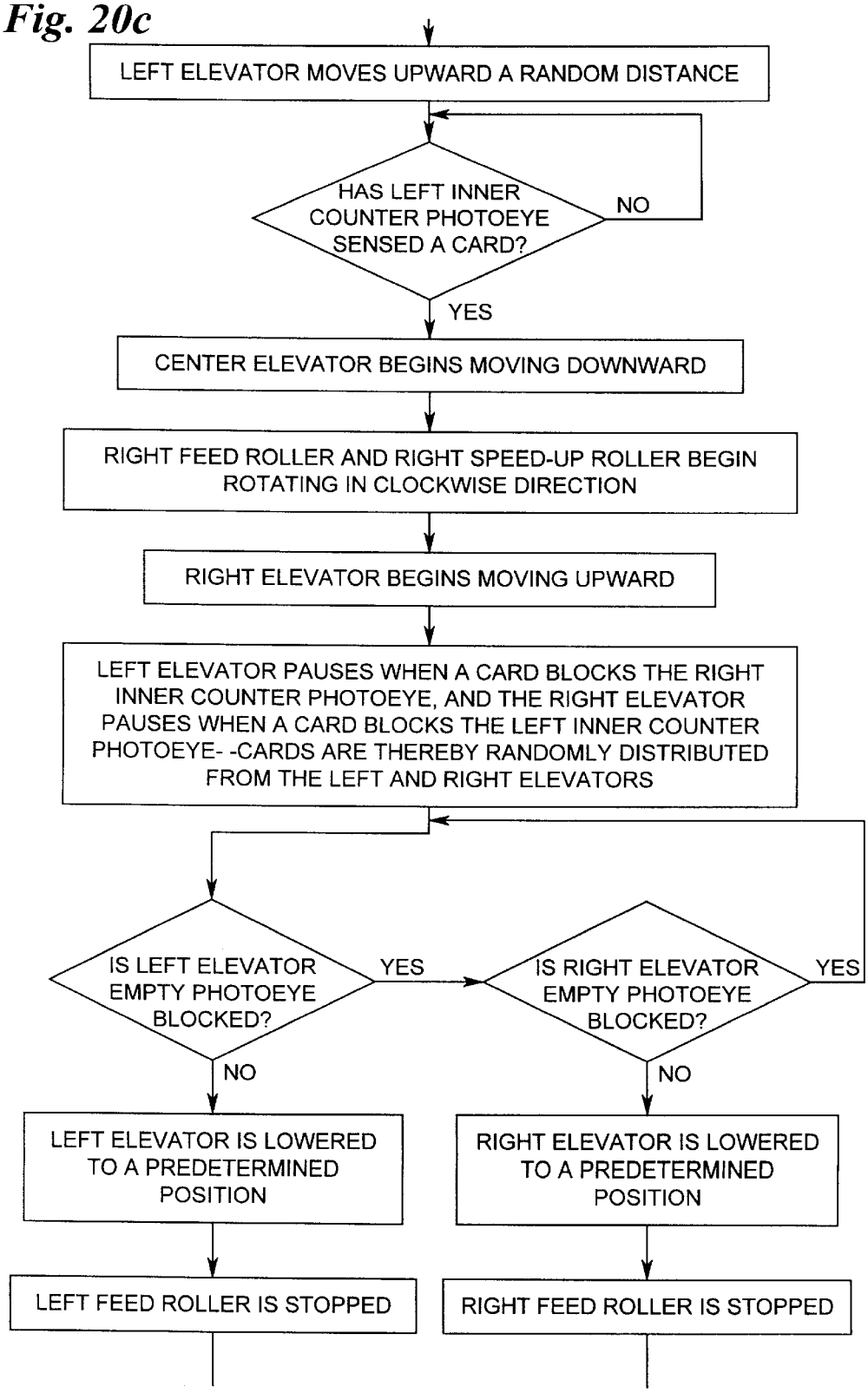
Figure 20D:
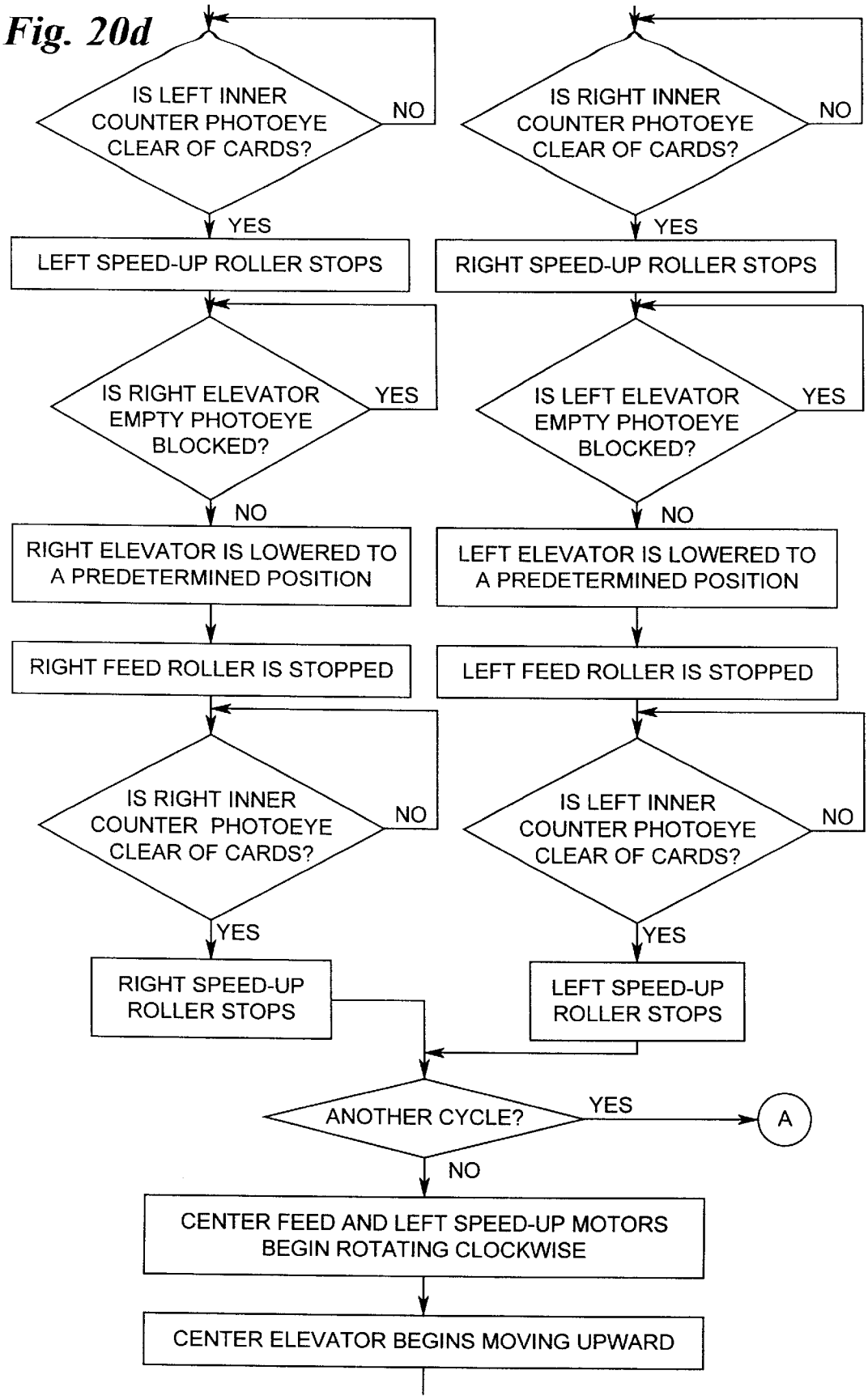
Figure 20E:
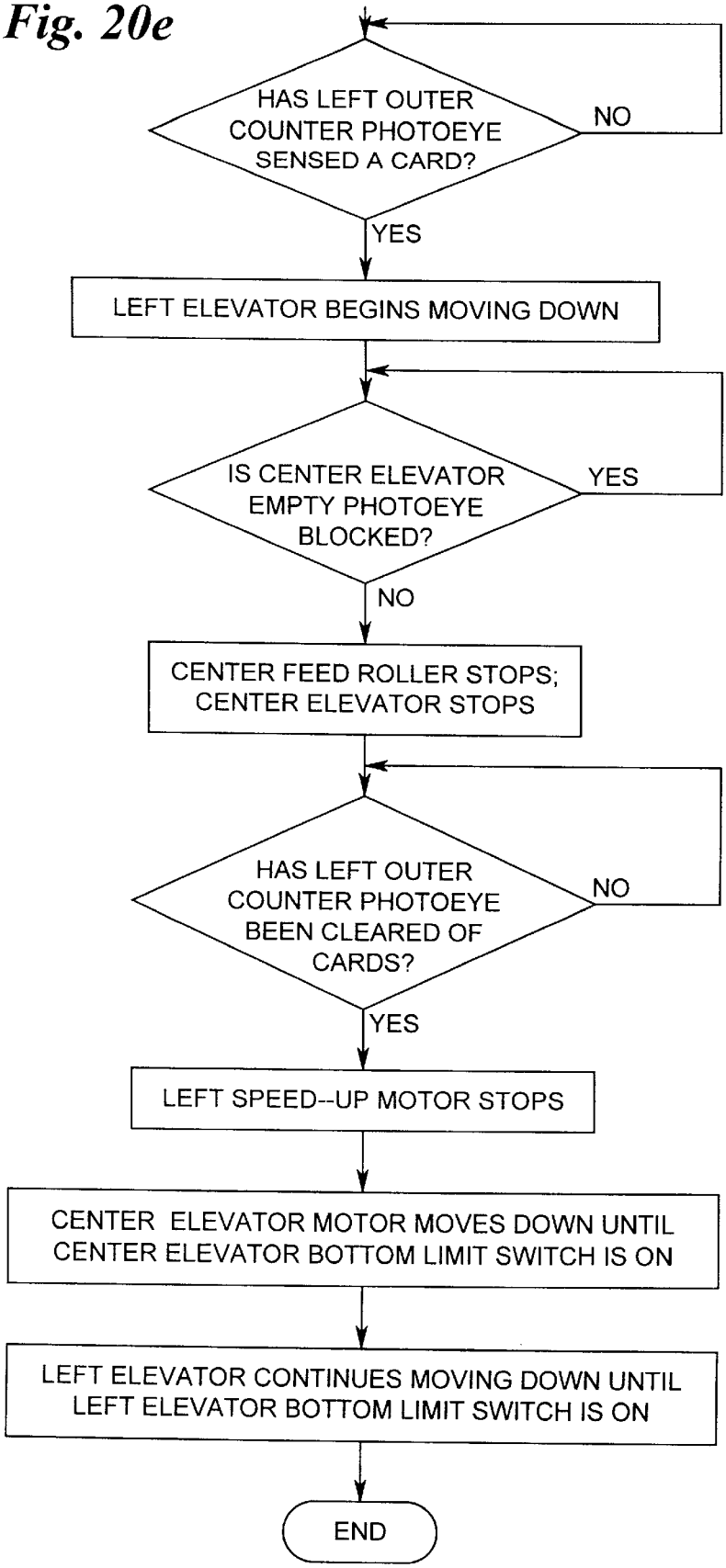

As shown in FIG. 20, after receiving the command to begin shuffling, the control system 46 does not commence with the shuffling operation until cards are in the center magazine 118 and until the left and right magazines 116, 120 are empty. The control system 46 checks for this condition by evaluating the state of the center, right, and left elevator photoeyes 88, 90, 92.

The control system 46 then causes the center elevator motor 50 to move the center elevator 262 up into an appropriate position for sending cards to the left magazine. The control system 46 properly positions the center elevator 262 by monitoring the center elevator top limit switch 70. The control system 46 then commences the clockwise,-simultaneous rotation of the center feed pick-off roller 190 and left speed-up roller 232 and the upward movement of the center elevator 262. This sequence of operations moves cards into the left magazine 116. (Theoretically, 0.010 inch of elevator travel (i.e., one card thickness) corresponds to one card being transferred.) When the first card goes through the left speed-up roller 232, the left outer photosensor 128 is blocked. The control system 46 recognizes this and begins moving the left elevator 260 down while the center elevator 262 is moved upwardly at the same speed. The cards from the center magazine 118 are thereby distributed to the left magazine 116.

The control system 46 continues to monitor the left outer counter photoeye 128 to determine when approximately half of the cards have been moved to the left magazine. (Alternatively, a timer, weight sensor, or any other indicator could be used to sense this condition.) After this determination is made, the center feed roller 190 reverses and begins turning counterclockwise. The control system 46 also stops the movement of left elevator 260 and starts the right speed-up roller 234 rotating counter-clockwise. When the control system 46 determines that the left outer counter photoeye 128 is clear of cards, the left speed-up roller 232 is stopped.

Two sets of photoeyes (inner and outer counter photoeyes) are used on each side of the speed-up rollers because the cards line up in partially overlapped condition up-stream of the speed-up rollers before they are picked up by the speed-up rollers. The gap between consecutive cards therefore does not materialize until the leading card is picked up by the speed-up roller and kicked out into the downstream magazine. Consequently, two photoeyes are provided for each speed-up roller so there is a downstream counter photoeye that can be used to register the gap in the card sequence, regardless of the direction of travel of the cards.

When the control system 46 determines that the first card has passed through the right speed-up roller 234 by monitoring the right outer counter photoeye 132, the right elevator 264 is moved downward. Cards are delivered from the center magazine 118 to the right magazine 120, each card passing before the right outer counter photoeye 132.

When the center magazine 118 is empty, the control system 46 will sense this condition via the center elevator empty photoeye 90, and then stop the center feed roller 190. The control system 46 also stops the downward movement of the right elevator 264 and the upward movement of the center elevator 262. After the control system 46 determines that the right outer counter photoeye 132 has been cleared of cards, the right speed-up roller 234 is also stopped. At this stage, the cards are cut: approximately half of the cards are in the left magazine 116, and approximately half of the cards are in the right magazine 120. The center magazine 118 is empty.

To begin the shuffling phase, the control system 46 begins rotating the left feed roller 200 and left speed-up roller 232 in the counter-clockwise direction. The control system 46 moves the left elevator 260 upward a random distance, thereby distributing a random number of cards from the left magazine 116 to the center magazine 118. As the first card from the left magazine 116 blocks the left inner counter photoeye 130, the center elevator 262 begins moving down. The random grouping of cards moved into the center magazine 118 is called a "clump." After this clump is moved to the center magazine 118, the control system 46 begins rotating the right feed roller 202 and the right speed-up roller 234 in the clockwise direction. Both the right and left elevators 260, 269 are then moved upward in a random fashion to thereby distribute cards from both the left and right magazines 116, 120 into the center magazine 118. When a card from the right magazine 120 blocks the right inner counter photoeye 134, the left elevator 260 stops. Similarly, when a card from the left magazine 116 blocks the left inner counter photoeye 130, the right elevator 264 stops. The elevators 260, 264 continue to stop and start randomly until all the cards have been distributed to the center magazine 118.

Since a clump of cards is taken from the left magazine 116 before any are taken from the right magazine 120, the left magazine 116 will generally be empty before the right magazine 120. When the control system 46 determines that the left magazine 116 is empty when the left elevator empty photoeye 88 is unblocked. The left elevator 260 is then reversed and lowered to a predetermined position, and the left feed roller 200 is stopped. After the control system 46 determines that the left inner counter photoeye 130 is cleared of cards, the left speed-up roller 232 stops rotating. Meanwhile, the remaining cards from the right magazine 120 are being distributed to the center magazine 118. When the control system 46 senses that the right elevator empty photoeye 92 is not blocked (indicating that the right magazine 120 is empty), the control system 46 moves the right elevator 264 to a predetermined position and the right feed roller 202 is stopped. When the control system 46 senses that the right inner counter photoeye 134 is clear of cards, the right speed-up roller 234 stops rotating. In the event that the right magazine 120 becomes empty before the left magazine 116 does, a parallel procedure is followed that mirrors the one described above. See FIG. 20.

At this stage, the cards are in a shuffled state in the center magazine 118. The machine 20 then proceeds to repeat the described cutting and shuffling operations a random number of times (e.g., six to eight cycles). At the end of the final cycle, the cards are transferred from the center magazine 118 to the left magazine 116 for removal by the dealer, and the center elevator 262 goes to its ready-to-load position. The dealer can open the door by pressing the start button. Unshuffled cards may be loaded into the center magazine 118 and the shuffled cards may be removed from the left magazine 116. After a few seconds, the door will automatically dose and a new shuffle commences.

Occasionally a jam may occur during the cutting (the movement of cards from the center to the left and right magazines) or shuffling (the random movement of cards from the left and right magazines 116, 118 to the center magazine 120) operations. The control system 46 is capable of sensing such a jam, and in the event of a jam, a recovery routine is carried out as described below.

When the cards are being cut from the center magazine 118 to the left magazine 116, the left outer counter photoeye 128 is alternatively blocked and unblocked as each card goes through the left speed-up roller 232. At a known delivery speed, the time interval between the blocked and unblocked states of the photoeye 128 is predictable. The control system 46 can therefore sense a jam by monitoring the left outer counter photoeye 128 for prolonged blocked states. A prolonged blocked state will suggest that a jam has occurred, and the control system 46 then initiates a "left-cut" recovery routine.

The left-cut recovery routine commences with the control system 46 stopping the center feed roller 190 and left speed-up roller 232. The center elevator 262 is reversed and moved down slightly (e.g, 0.25 inches). The left speed-up roller 232 is reversed so that it is rotating in the counter-clockwise direction, and it continues rotating counter-clockwise until the left inner counter photoeye 130 is clear for a short period of time (e.g., 0.5 seconds). The left speed-up roller 232 then resumes the normal clockwise rotation. The center feed roller 190 is rotated in the clockwise direction, the center elevator 262 moves up, and the cutting operation resumes. The left elevator 260 does not move down until a card goes through the left outer counter photoeye 128.

The control system can similarly recover from a jam that occurs when the cards are being cut from the center magazine to the right magazine. The right recovery routine commences with the control system 46 stopping the center feed roller 190 and the right speed-up roller 234. The center elevator 262 is reversed and moved down slightly (e.g, 0.25 inches). The right speed-up roller 234 is reversed so that it is rotating in the clockwise direction, and it continues rotating clockwise until the right inner counter photoeye 134 is clear for a short period of time (e.g., 0.5 seconds). The right speed-up roller 234 then resumes the counter-clockwise rotation. The center feed roller 190 is rotated in the counter-clockwise direction, the center elevator 262 moves up, and the cutting operation resumes. The right elevator 264 does not move down until a card goes through the right outer counter photoeye 132.

If a jam occurs during the shuffling operation, the control system 46 stops the left and right speed-up rollers 232, 234 and the left and right feed rollers 200, 202. Both the left and right elevators 260, 264 are lowered about 0.25 inches and held in that position. The control system 46 rotates the left speed-up roller 232 in a clockwise direction and the right speed-up roller 234 in a counter-clockwise direction. When the control system 46 senses that the left and right outer counter photoeyes 128, 132 are clear, left feed roller 200 and the left speed-up roller 232 resume rotating in the counter-clockwise direction, and the right feed roller 202 and right speed-up roller 234 resume rotating in the clockwise direction. The control system 46 then moves the left and right elevators 260, 264 upwardly, thereby resuming the shuffling operation. The control system 46 waits until it senses a card passing before either the left or the right inner counter photoeye 130, 134 before moving the center elevator 262 downward.

The shuffling machine 20 attempts to recover from jams automatically, without human intervention. However, if after several attempts, the shuffling machine 20 is not able to recover, the control system 46 will suspend the operation of the machine 20 and will flash the red alarm light. The control system 46 will then await intervention. The operator intervenes by pressing the "open Door" button at the control panel. The control system 46 will move the door down and will move the elevators down about two inches. The operator can then manually clear the jam, and leave the cards in the machine 20. The green "Start" button is pressed to resume the shuffling operation. The machine 20 will go through one complete shuffle cycle after manual intervention no matter when in the shuffle cycle the jam occurred.

If it is determined that, after a jam, a minimum of three shuffle cycles are desired, the "Reset" push button on the control panel should be pushed. The "Reset" feature is only active after the "open Door" push button has been activated. The machine 20 will go through the homing sequence and, when the green "Start" button lights, will be ready for a minimum of three shuffle cycles.

For a complete reshuffle, the power button should be turned off, all cards removed, the power turned back on. The machine 20 will go through the homing sequence and, when the green "Start" button lights, the machine 20 is ready for a new shuffle.

Although the description of the preferred embodiment has been presented, various changes including those mentioned above could be made without deviating from the spirit of the present invention. It is desired, therefore, that reference be made to the appended claims rather than to the foregoing description to indicate the scope of the invention.

Appendix A: Identification Key to Motors and Switches

| Abbreviation | Description | Reference Character in FIGS. |
|---|---|---|
| MOTORS | | |
| | Left Elevator Motor | 48 |
| CEM | Center Elevator Motor | 50 |
| REM | Right Elevator Motor | 52 |
| DM | Door Motor | 64 |
| LFM | Left Feed Motor | 54 |
| CFM | Center Feed Motor | 56 |
| RFM | Right Feed Motor | 58 |
| LSM | Left Speed-Up Motor | 60 |
| RSM | Right Speed-Up Motor | 62 |

-continued

Appendix A: Identification Key to Motors and Switches

| Abbreviation | Description | Reference Character in FIGS. |
|---|---|---|
| LIMIT SWITCHES | | |
| LEB-LS | Left Elevator Bottom-Limit Switch | 68 |
| LET-LS | Left Elevator Top-Limit Switch | 70 |
| CEB-LS | Center Elevator Bottom-Limit Switch | 72 |
| CET-LS | Center Elevator Top-Limit Switch | 74 |
| REB-LS | Right Elevator Bottom-Limit Switch | 76 |
| RET-LS | Right Elevator Top Limit Switch | 78 |
| DB-LS | Door Bottom-Limit Switch | 80 |
| DT-LS | Door Top-Limit Switch | 82 |
| PHOTOEYES | | |
| LEMT-PE | Left Elevator Empty-Photoeye | 88 |
| CEMT-PE | Center Elevator Empty-Photoeye | 90 |
| REMT-PE | Right Elevator Empty-Photoeye | 92 |
| LOC-PE | Left Outer Counter-Photoeye | 128 |
| ROC-PE | Right Outer Counter-Photoeye | 132 |
| LIC-PE | Left Inner Counter-Photoeye | 130 |
| RIC-PE | Right Inner Counter-Photoeye | 134 |

Appendix B: Sequence of Operations

| Action | Explanation | Motor | Switch |
|---|---|---|---|
| 1. Power Up | Machine homes. See homing sequence. | | |
| 2. Load cards to be shuffled | 4, 6, or 8 decks are loaded in the center magazine. | | CEMT-PE off (blocked) |
| 3. Door closes. | Operator presses the start button and door moves up, making door top limit switch. | DM on (up)<br>DM off | START |
| | Interlocks: | | DT-LS on |
| | A. Cards must be present in the center magazine.<br>B. Left and right elevators have to be empty. If not, machine will pause until the cards are removed. | | CEMT-PE off<br>LEMT-PE on<br>REMT-PE on |
| 4. Center elevator moves up (first cycle). | A. Center elevator moves up until the cards are activating center elevator top limit switch CET-LS. Cards are checked for height. | CEM on (up) | CET-LM on |
| | B. Center elevator then moves down (timed move) approximately 0.5 inches. | CEM rev (down) | |
| 5. Cut to left (first cycle.) | The center feed roller and the left speed-up rollers start to rotate clockwise. At the same time, the center elevator moves up. As the center elevator moves up, cards are | CFM on (CW)<br>LSM on (CW)<br>CEM on (up)<br>CEM on (up) | LOC-PE off/on |

-continued

Appendix B: Sequence of Operations

| Action | Explanation | Motor | Switch |
|---|---|---|---|
| | delivered into the left magazine, each card breaking the left outer counter photoeye. | LEM on (down) | LOC-PE off |
| | When the first card goes through the left speed-up rollers, the left outer counter photoeye is blocked. | | |
| | The left elevator motor is then turned on, driving the elevator down. Center and left elevators are going the same speed. | | |
| 6. Cards are delivered into the right magazine. Cut to right. | After half the cards are delivered into the left magazine, center feed motor is reversed (counter clockwise). At the same time, the right speed-up motor starts to rotate counter clockwise and the left elevator motor stops. | CFM rev (CCW)<br>RSM on (CCW)<br>LEM off | |
| | When the left outer counter photoeye is clear of cards, left speed-up motor stops. | LSM off | LOC-PE on |
| | When the first card goes through the right speed-up rollers, the right outer counter photoeye is blocked. | | ROC-PE off |
| | The right elevator motor is then turned on, driving the elevator down. Cards are delivered from center to right, each card breaking the right outer counter photoeye. | REM on (down) | ROC-PE off/on |
| | When the center elevator goes empty, the enter elevator empty photoeye (CEMT-PE) turns on. | CEM rev (down) | CEMT-PE on |
| | The center elevator motor is reversed, the center feed motors and the right speed-up motors are turned off. | CFM off<br>RSM off | ROC-PE on |
| | The right out counter photoeye has to be on (clear) | | |
| | Interlocks: | | |
| | A. The left elevator motor is turned off if the left elevator top limit switch is made. | LEM off | LET-LS on |
| | B. The right elevator motor is turned off if the right elevator top limit switch is made. | REM off | RET-LS on |
| 7. Cards are delivered to the center from left. CLUMP. | When the center elevator moves down, the left feed and the left speed-up motors start counter clockwise. | CEM on (down)<br>LFM on (CCW)<br>LSM on (CCW) | |
| | The left elevator motor starts to move up. | LEM on (up) | |
| | NOTE: The left and the center elevator moves should be synchronized. When the left elevator reaches the feed roller, the center elevator should be at the optimum height to receive the cards. | | |
| | Cards begin to move frorn left to center, breaking the left inner counter photoeye. | | LIC-PE off/on |
| | The left elevator moves up a randorn distance, delivering a random number of cards to the center (clump.) | | |
| 8. Cards are shuffled to the center randomly. SHUFFLE. | The right elevator upward move is delayed to obtain the clump. When the right elevator starts to move up, the right feed ad the right speed-up rollers start to rotate clockwise. | REM on (up)<br>RFM on (CW)<br>RSM on (CW) | |

-continued

Appendix B: Sequence of Operations

| Action | Explanation | Motor | Switch |
|---|---|---|---|
| | As the first card from the right magazine blocks the right outer counter photoeye, the left elevator stops and the right and left elevators will be synchronized from this point on. The moves will be random. | LEM off/on | |
| | When the right elevator moves up, the left one is stopped and vice versa. | REM off/on | |
| | When the left elevator is empty, the photoeye is unblocked (no cards), the left elevator reverses and goes to a predetermined position for receiving cards. | LEM rev (down)<br>LEM off | LEMT-PE on |
| | The left feed roller stops. | LFM off | |
| | The left speed-up rollers stop when the left outer counter photoeye stays unblocked for approximately 0.5 seconds (to make sure cards are out of the pinch). | LSM off | LOC-PE on (0.5 sec?) |
| | When the right elevator is empty, the left outer counter photoeye is unblocked (no cards), the right elevator reverses and goes to a set position for receiving cards. | REM rev (down)<br>REM off | REMT-PE on |
| | The right feed roller stops. | RFM off<br>RSM off | |
| | The right speed-up rollers stop when the right outer counter photoeye stays unblocked for 0.5 seconds. | | ROC-PE on (0.5 sec) |
| 9. Cut to left | When the right elevator empty photoeye is unblocked, the center elevator starts to move up, the center feed and the left speed-up rollers start to rotate clockwise, delivering cards to the left. Cycle repeats from 6. to 9., ending with 8. | CEM on (up)<br>CFM on (CW)<br>LSM on (CW) | REMT on |
| 10. Transfer to the left magazine and counting. | After the last cycle, the cards are transferred from the center to the left magazine for removal. | | |
| | After the last shuffle (8.), the right feed and speed-up rollers stop and the right elevator goes to a set position to receive cards. | RFM off<br>RSM off<br>REM rev off | |
| | The center elevator moves up. | CEM on (up) | |
| | The center feed and the left speed-up rollers start to rotate clockwise, delivering cards to the left elevator. | CFM on (CW)<br>LSM on (CW) | |
| | When the center elevator empty photoeye is unblocked (no cards), the center elevator is reversed and goes down until it makes the center elevator bottom limit switch (read to load position). | CEM rev (down)<br>CEM off | CEMT-PE on<br>CEM-LS on |
| | The center feed roller also stops. | CFM off | |
| | When the left outer counter photoeye is unblocked for 0.5 seconds, the left speed-up rollers are turned off. | LSM off | LOC-PE on |
| | The left elevator moves down until it makes the left elevator bottom limit switch. | LEM on<br>LEM off | LEB-LS on |
| 11. Loading and unloading. | Operator presses the start button. Door moves down, making door bottom limit switch. | DM on (down) | Start<br>DB-LS on |
| | Cards are loaded into the center magazine. | DM off | |
| | Center elevator empty photoeye is blocked. | | CEMT-PE off |

-continued

Appendix B: Sequence of Operations

| Action | Explanation | Motor | Switch |
|---|---|---|---|
| | Shuffled cards are removed from the left magazine. Left elevator empty photoeye is unblocked. | | LEMT-PE on |
| 12. Door closes. | After seconds, the left elevator moves up and the door will automatically close in 3–4 seconds, making door top limit switch. | LEM on<br>DM on | DT-LS on |
| | Before the door starts to move, the light will come on as a warning. | DM on ½ power | |
| A new shuffle cycle begins . . . | | | |

Appendix C: Homing Sequence

| Action | Description | Motor | Switch |
|---|---|---|---|
| 1. Power on. No cards in the machine | If there are no cards in the machine, elevator empty and counter photoeyes unblocked, the machine will go through the homing sequence. The door moves down. | | REMT-PE on<br>CEMT-PE on<br>LEMT-PE on<br>ROC-PE on<br>RIC-PE on<br>LOC-PE on<br>LIC-PE on |
| | The left and right elevators move up and make left and right elevator top limit switches. | DM on (down)<br>LEM on (up) | DB-LS on<br>LET-LS on |
| | The center elevator moves down, making center elevator bottom limit switch. | REM on (up)<br>CEM on (down) | RET-LS on<br>RET-LS on<br>CEB-LS on |
| | The left and right elevators move down to a pre-determined location to receive the cards. | LEM on (down)<br>REM on (down) | Timed<br>Timed |
| 2. Power on. Cards in the machine. | A. If there are cards in any of the speed up roller assemblies, one or more of the counter photoeyes blocked, the door moves up, the speed-up rollers start up and deliver cards onto the left and/or the right elevators. | DM on (up)<br>LSM on (CW)<br>RSM on (CCW)<br>LSM off<br>RSM off | DT-LS on<br>LIC-OE on<br>LOC-PE on<br>RIC-PE on<br>ROC-PE on |
| | When the counter photoeyes are unblocked for at least 0.5 seconds, the speed-up motors are turned off and the door moves down. | DM on (down) | DB-LS on |
| | B. If there are cards on any of the elevators, one of more of the elevator empty photoeyes blocked, the door moves down and the red alarm light will flash, indicating that the machine is not ready for loading. | DM on (down) | |
| | Take the cards out of the machine and press the START key. The machine will go through the homing sequence. | | |

Appendix D: Component Manufacturers, Addresses and Part/Model Nos.

| Abbreviation & Reference Char. | Component Description, Manufacturer Name and Address | Manufacture's Part or Model No. |
|---|---|---|
| MOTORS | | |
| LEM (48) | Stepping Motor, 4 volt D.C. Oriental Motor USA Corporation, Torrance, California | PX243G01-01A |
| CEM (50) | Stepping Motor, 4 volt D.C. Oriental Motor USA Corporation, Torrance, California | PX243G01-01A |
| REM (52) | Stepping Motor, 4 volt D.C. Oriental Motor USA Corporation, Torrance, California | PX243G01-01A |
| DM (64) | Stepping Motor, 4 volt D.C. Oriental Motor USA Corporation, Torrance, California | PK244-01AA |
| LFM (54) | Stepping Motor, 4 volt D.C. Oriental Motor USA Corporation, Torrance, California | PK245-01AA |
| CFM (56) | Stepping Motor, 4 volt D.C. Oriental Motor USA Corporation, Torrance, California | PK245-01AA |
| RFM (58) | Stepping Motor, 4 volt D.C. Oriental Motor USA Corporation, Torrance, California | PK245-01AA |
| LSM (60) | Stepping Motor, 4 volt D.C. Oriental Motor USA Corporation, Torrance, California | PK245-01AA |
| RSM (62) | Stepping Motor, 4 volt D.C. Oriental Motor USA Corporation, Torrance, California | PK245-01AA |
| LIMIT SWITCHES | | |
| LEB-LS (68) | MICRO SWITCH, a division of Honeywell Corporation, Minneapolis, Minnesota | N14 |
| LET-LS (70) | MICRO SWITCH, a division of Honeywell Corporation, Minneapolis, Minnesota | 37XL31-01 |
| CEB-LS (72) | MICRO SWITCH, a division of Honeywell Corporation, Minneapolis, Minnesota | N14 |
| CET-LS (74) | MICRO SWITCH, a division of Honeywell Corporation, Minneapolis, Minnesota | 37XL31-01 |
| REB-LS (76) | MICRO SWITCH, a division of Honeywell Corporation, Minneapolis, Minnesota | N14 |
| RET-LS (78) | MICRO SWITCH, a division of Honeywell Corporation, Minneapolis, Minnesota | 37XL31-01 |
| DB-LS (80) | MICRO SWITCH, a division of Honeywell Corporation, Minneapolis, Minnesota | N14 |
| DT-LS (82) | MICRO SWITCH, a division of Honeywell Corporation, Minneapolis, Minnesota | N14 |
| PHOTOEYES | | |
| LEMT-PE (88) | Optek Technology, Inc., Carrolton, Texas | OP265A, OP598 |
| CEMT-PE (90) | Optek Technology, Inc., Carrolton, Texas | OP265A, OP598 |
| REMT-PE (92) | Optek Technology, Inc., Carrolton, Texas | OP265A, OP598 |
| LOC-PE (128) | Optek Technology, Inc., Carrolton, Texas | OP506A |
| ROC-PE (132) | Optek Technology, Inc., Carrolton, Texas | OP506A |
| LIC-PE (130) | Optek Technology, Inc., Carrolton, Texas | OP506A |
| RIC-PE (134) | Optek Technology, Inc., Carrolton, Texas | OP506A |

What is claimed is:

1. A recovery method for recovering from a card jam in an apparatus for automatically shuffling cards, the apparatus including a card mover for moving the cards and sensors for monitoring movement of the cards wherein, during normal movement, the cards are moved substantially one at a time and the sensors are alternately blocked and unblocked, said recovery method comprising the steps of:

sensing a prolonged blocked state thereby indicating that the card jam has occurred;

altering the normal movement of the cards;

sensing an end of the prolonged blocked state; and resuming the normal movement of the cards.

2. The recovery method according to claim 1, wherein the card mover is operable to reverse the normal movement of cards.

3. The recovery method according to claim 1, wherein the movement of cards is monitored by a plurality of sensors.

4. The recovery method according to claim 1, wherein the sensors sense a gap between the cards as the cards move and wherein the card jam comprises a lack of the gap.

5. The recovery method according to claim 1, wherein the apparatus attempts the recovery method automatically and, after several unsuccessful attempts to recover from the card jam, signals to an operator for intervention.

6. A card shuffling apparatus comprising a card moving mechanism, comprising card engaging members, that substantially and one at a time moves cards from a first and a second group of cards into a common shuffled group of cards, wherein said card moving mechanism and card engaging members are operable to change the card movement to recover from a card jam.

7. The card shuffling apparatus according to claim 6, wherein said card moving mechanism is selectively operable to reverse the moving of the cards.

8. The card shuffling apparatus according to claim 6, further comprising card deflectors adjacent to the card moving mechanism for deflecting the cards as the cards are moved.

9. The card shuffling apparatus according to claim 6, including a card stop region for temporarily receiving a leading edge of each card as the cards are moved.

10. An apparatus for shuffling playing cards comprising:

a card-moving mechanism;

a processing unit that controls the card-moving mechanism so that each card is moved to one of a first and a second stationary compartments, wherein each compartment contains a group of cards, and said processing unit also controls the card-moving mechanism so that cards are moved from said stationary compartments.

a data storage medium accessible by the processing unit, wherein the data storage medium has a program stored on it, and wherein in the program is configured to cause the processing unit to cause the card-moving mechanism to move cards substantially one at a time from both said first and said second stationary compartments into a common shuffled group.

11. The apparatus of claim 10 further comprising at least one sensor for monitoring the movement of cards, wherein during normal movement, the at least one sensor is alternately blocked and unblocked; and wherein the data storage medium is further configured to cause the processing unit to:

detect a card jam sensing a prolonged block of the at least one sensor; and recover from the card jam by changing the movement of the cards.

12. A data storage medium for use with a processing unit that controls a card moving mechanism so that cards are moved substantially one at a time to and from one or more groups of cards, wherein the data storage medium has a program stored on it that causes the card moving mechanism to:

move cards substantially one at a time from a first group of cards to one of a first and a second stationary compartments forming a second group and a third group of cards, respectively thereby cutting the first group of cards, and move the second and third group of cards substantially one at a time from both the stationary compartments into a shuffled group of cards.

13. A recovery method for recovering from a card jam in an apparatus for automatically shuffling cards, the apparatus including sensors for monitoring movement of the cards wherein, during normal movement, the sensors are alternately blocked and unblocked, said recovery method including the steps of:

sensing a prolonged blocked state thereby indicating that the card jam has occurred;

selectively altering the movement of the cards;

sensing an end of the prolonged blocked state; and resuming the normal movement of the cards.

14. The recovery method according to claim 13, wherein the apparatus includes card movers operable to alter the movement of the cards.

15. The recovery method according to claim 13, wherein said selectively altering comprises reversing the normal movement of the cards.

16. The recovery method according to claim 15, wherein the apparatus includes card movers operable to reverse the normal movement of the cards.

17. The recovery method according to claim 13, wherein the movement of cards is monitored by a plurality of sensors.

18. The recovery method according to claim 17, wherein the sensors sense a gap between the cards as the cards move and wherein the card jam comprises a lack of the gap.

19. The recovery method according to claim 13, wherein the apparatus attempts the recovery method automatically and, several unsuccessful attempts to recover from the card jam, signals to an operator for intervention.

* * * * *

UNITED STATES PATENT AND TRADEMARK OFFICE

CERTIFICATE OF CORRECTION

PATENT NO. : 6,139,014
DATED : October 31, 2000
INVENTOR(S) : John G. Breeding et al.

It is certified that error appears in the above-identified patent and that said Letters Patent is hereby corrected as shown below:

Column 1

Please cancel lines 5-9, and insert the following:

-- RELATED APPLICATIONS

This application is a continuation of U.S. Patent Application Serial No. 08/504,035, filed July 19, 1995, now U.S. Patent No. 5,695,189, which is a continuation of U.S. Patent Application serial No. 08/287,729, filed August 9, 1994, now abandoned. Applicant also claims continuation-in-part status from case Serial No. 08/043,413, filed April 6, 1993, now U.S. Patent 5,417,430 and continuation-in-part status from case Serial No. 08/004,557, filed January 14, 1993, now U.S. Patent No. 5,275,411. --

Signed and Sealed this

Twelfth Day of October, 2004

JON W. DUDAS

*Director of the United States Patent and Trademark Office*